US011434659B2

(12) United States Patent
Wu et al.

(10) Patent No.: US 11,434,659 B2
(45) Date of Patent: Sep. 6, 2022

(54) LOCK DEVICE

(71) Applicant: SINOX CO., LTD, New Taipei (TW)

(72) Inventors: Chia-Ming Wu, New Taipei (TW); Kuo-Kuang Pan, New Taipei (TW)

(73) Assignee: SINOX CO., LTD, New Taipei (TW)

( * ) Notice: Subject to any disclaimer, the term of this patent is extended or adjusted under 35 U.S.C. 154(b) by 342 days.

(21) Appl. No.: 16/779,981

(22) Filed: Feb. 3, 2020

(65) Prior Publication Data

US 2020/0248477 A1 Aug. 6, 2020

Related U.S. Application Data

(60) Provisional application No. 62/800,651, filed on Feb. 4, 2019.

(51) Int. Cl.
*E05B 15/00* (2006.01)
*E05B 17/14* (2006.01)

(52) U.S. Cl.
CPC ..... *E05B 15/008* (2013.01); *E05B 17/142* (2013.01)

(58) Field of Classification Search
CPC .. E05B 15/00; E05B 15/0046; E05B 15/0053; E05B 15/008; E05B 2015/0066; E05B 17/00; E05B 17/14; E05B 17/142
USPC ..... 70/336
See application file for complete search history.

(56) References Cited

U.S. PATENT DOCUMENTS 505,299 A 9/1893 Schneider
6,523,373 B1 2/2003 Su
7,234,326 B1 * 6/2007 Lu ..... E05B 73/0082 70/57
7,302,816 B1 * 12/2007 Lu ..... E05B 73/0082 70/49
2007/0169523 A1 7/2007 Lu
2008/0258475 A1 * 10/2008 Chung ..... E05C 9/1875 292/25
2019/0032369 A1 1/2019 Ke et al.

FOREIGN PATENT DOCUMENTS

EP 3 406 828 A1 11/2018

OTHER PUBLICATIONS

Great Britain Office Action and Search Report for Great Britain Application No. GB2001441.1, dated Jul. 28, 2020.

* cited by examiner

*Primary Examiner* — Nathan Cumar

(74) *Attorney, Agent, or Firm* — Birch, Stewart, Kolasch & Birch, LLP

(57) ABSTRACT

A lock device is provided. The lock device includes a housing with a front opening at an end; a rotating hook disposed in the housing and being rotatable relative to the housing, the rotating hook including a front-end portion and a rear-end portion, the front-end portion at least partially protruding from the front opening, and the rear-end portion extending toward a direction opposite to the front-end portion; a driving device disposed in the housing and selectively moveable to change widths by which the front-end portion is opened respectively; and a lock body disposed in the housing, when the lock body is locked, the lock body restricting a movement of the driving device.

9 Claims, 39 Drawing Sheets

LOCK DEVICE

CROSS REFERENCE TO RELATED APPLICATIONS

This non-provisional application claims the benefit under 35 U.S.C. § 119(e) to U.S. Provisional Application No. 62/800,651, filed on Feb. 4, 2019, which is hereby expressly incorporated by reference into the present application.

BACKGROUND

Field of the Invention

The present invention generally relates to a lock device for use with an electronic device.

Related Art

In modern life, because consumer electronic products play an important role, a fast lifestyle is formed, and people have a demand for instant information, portable electronic products become one of necessities of the people. However, due to relatively high unit prices and ease of realization, these products are more likely to be stolen or robbed.

In order to prevent others from stealing these products, a lock device is designed, for example: a notebook computer lock that may be connected to an anti-theft lock hole of an electronic product through a lock fastener of the notebook computer lock, and a movement of the lock fastener is controlled through a key lock mechanism to complete locking/unlocking. However, the anti-theft lock holes have different specifications, so that a user must purchase/carry a lock with a corresponding lock fastener according to the specification of the anti-theft lock hole, which is not only uneconomical but also inconvenient to use.

SUMMARY OF THE INVENTION

The lock device of the present invention includes a housing with a front opening at an end, a rotating hook disposed in the housing and being rotatable relative to the housing, a driving device disposed in the housing and selectively moveable to change widths by which the front-end portion is opened respectively, and a lock body disposed in the housing. The rotating hook includes a front-end portion and a rear-end portion. The front-end portion at least partially protruded from the front opening. The rear-end portion extends toward a direction opposite to the front-end portion. When the lock body is locked, the lock body restricts a movement of the driving device.

In one embodiment, the lock device includes at least two rotating hooks being rotatable relative to the housing along a plane parallel to an X-Y plane. The driving device may be selectively moved to extend along a Z-axis direction by different depths to be between the rear-end portions, respectively, so that the width by which the front-end portion is opened is changed. When the lock body is locked, the lock body restricts the movement of the driving device along the Z-axis direction, an X axis, a Y axis, and a Z axis being orthogonal.

In one embodiment, the driving device comprises a driving member and a force applying member. The driving member includes a driving member top surface located on one side of the driving member and a driving member bottom surface located on one side of the driving member opposite to the driving member top surface. The driving member bottom surface orients toward the rotating hooks and has a driving portion, wherein the driving portion corresponds to a gap between the rear-end portions. When the driving member is moved toward the rotating hook along the Z-axis direction, the driving portion may extend into the gap between the rear-end portions to abut against the rear-end portions to cause the rear-end portions to be away from each other, thereby causing the front-end portions to be away from each other. The force applying member is rotatable relative to the housing along the plane parallel to the X-Y plane and includes a force applying member top surface and a force applying member bottom surface located on opposite sides of the force applying member. The force applying member bottom surface orients toward the driving member and has a force applying portion unit, wherein the force applying portion unit corresponds to the driving member top surface.

In one embodiment, the driving device further comprises an elastic device disposed between the driving member and an inner wall of the housing and providing an elastic force along the Z-axis direction.

In one embodiment, the driving member top surface includes a guide ramp having a plurality of steps and a stop disposed at a position adjacent to a bottom surface of the guide ramp, wherein the driving member top surface has a top surface position between the bottom surface of the guide ramp and the stop.

In one embodiment, a braking element is disposed at an end of the lock body. When the lock body is locked, the braking element protrudes toward the force applying member to be engaged with the force applying member to restrict a rotation of the force applying member, thereby restricting a movement of the driving device along the Z-axis direction.

In one embodiment, the braking element has a fixing hole. A periphery of the force applying member has a plurality of fixing portions. When the lock body is locked, the braking element protrudes toward the force applying member, so that at least one of the fixing portions is inserted into the fixing hole.

In one embodiment, the driving device includes a driving member comprising a driving member bottom surface orienting toward the rotating hooks and having a plurality of driving portions. The driving member may be rotated to cause one of the driving portions to correspond to a gap between the rear-end portions. When the driving member is moved toward the rotating hook along the Z-axis direction, the corresponding driving portion may extend into the gap between the rear-end portions to abut against the rear-end portions to cause the rear-end portions to be away from each other, thereby causing the front-end portions to be away from each other.

In one embodiment, the engaging piece penetrates the second puller through the engaging hole.

In one embodiment, the driving device further includes an elastic device disposed between the driving member and an inner wall of the housing and providing an elastic force along the Z-axis direction.

In one embodiment, the lock device includes at least two rotating hooks being rotatable relative to the housing along a plane parallel to an X-Y plane. The driving device may be selectively moved along a Y-axis direction to extend by different depths to be between the rear-end portions, respectively, so that the width by which the front-end portion is opened is changed. When the lock body is locked, the lock body restricts the movement of the driving device along the Y-axis direction.

In one embodiment, the driving device includes a driving member and a force applying member. The driving member includes a driving portion extending along the Y-axis direction and a driving member shaft extending along a Z axis. The driving member may move along the Y axis direction, so that the driving portion is inserted into a gap between the rear-end portions to abut against the rear-end portions to cause the rear-end portions to be away from each other, thereby causing the front-end portions to be away from each other. The force applying member is disposed in the housing and located on one side of the driving member. The force applying member has a force applying hole for the driving member shaft to be inserted into, wherein the force applying member may rotate relative to the housing along a plane parallel to the X-Y plane.

In one embodiment, an inner edge of the force applying hole includes a plurality of recesses. When the force applying member rotates relative to the housing along the plane parallel to the X-Y plane, the driving member shaft may abut against the inner edge of the force applying hole and enter one of the recesses.

In one embodiment, the driving device further comprises an elastic device disposed between the driving portion and the rear-end portion and providing an elastic force along the Y-axis direction.

In one embodiment, the lock device further comprises an end engaging part extending outward from the front opening and being adjacent to the rotating hook. The driving device includes a driving member and a restricting part. The driving member is able to push the rear-end portions along the Y-axis direction, thereby causing the front-end portion to be away from the end engaging part. The restricting part is disposed in the housing for restricting the movement of the driving device along the X-axis direction.

DETAILED DESCRIPTION

Figure 1:
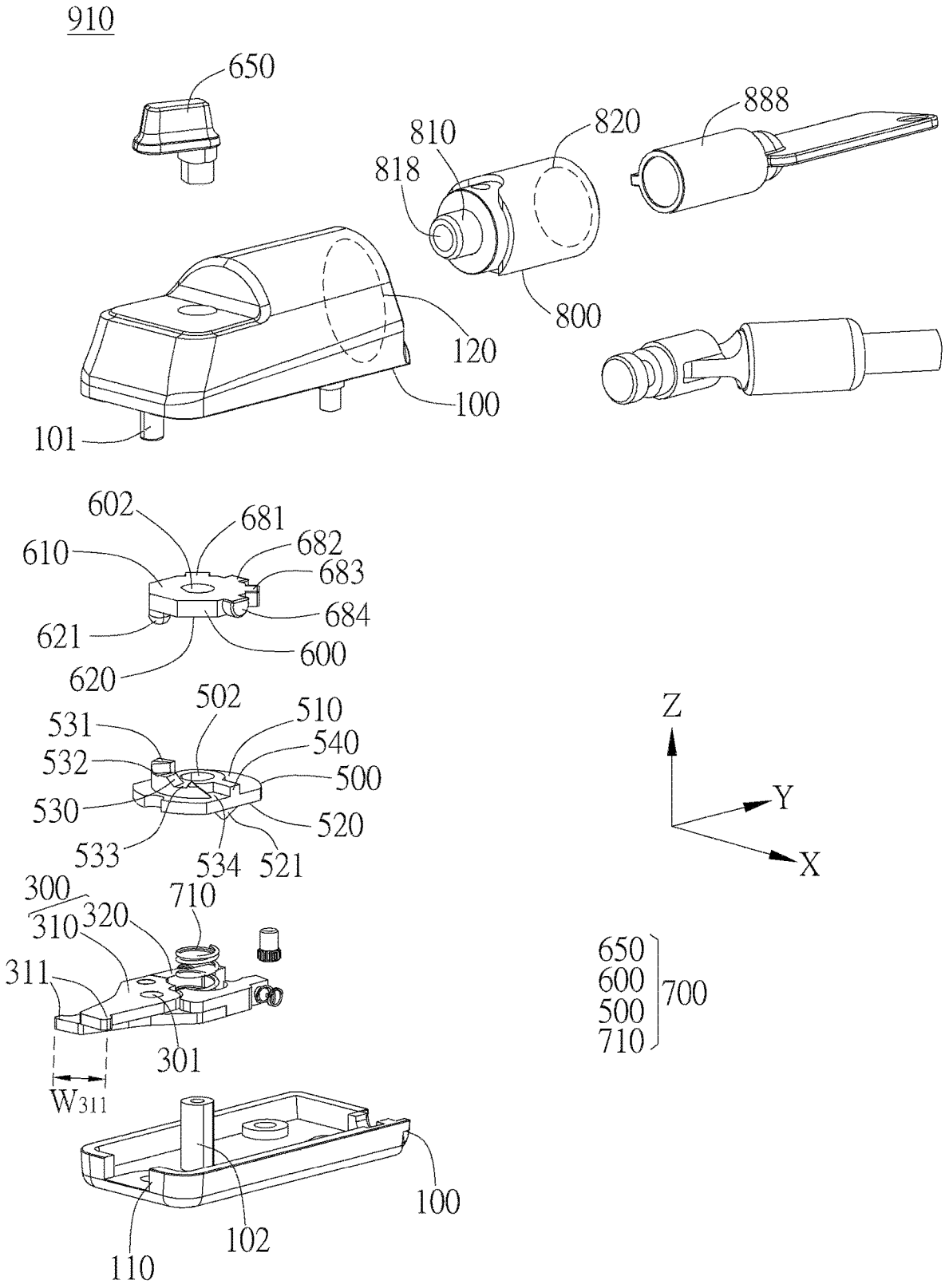
FIG. 1 is exploded view of an embodiment of the lock device of the present invention.

The connecting elements according to the present invention will be described in detail below through embodiments and with reference to the accompanying drawings, a person having ordinary skill in the art may understand the advantages and effects of the present disclosure through the contents disclosed in the present specification. However, the contents shown in the following sentences never limit the scope of the present disclosure. Without departing from the conception principles of the present invention, a person having ordinary skill in the present art may realize the present disclosure through other embodiments based on different views and applications. In the attached FIGs, for the purpose of clarification, the thicknesses of layers, films, panels, regions and the like are amplified. In the whole specification, the same marks represent the same element. It should be understood that, when an element such as a layer, a film, a panel, a region or a substrate are described as "being on" or "being connected to" another element, they may be directly on or connected to another element, or there may be other elements therebetween. On the other hand, when an element is described as "directly existing on another element" or "being directly connected to" another element, there is no element therebetween. As used in the present specification, a "connection" may be a physical and/or electrical connection. In addition, an "electrical connection" or "coupling" means that other elements may exist therebetween.

It should be understood that, even though the terms such as "first", "second", "third" may be used to describe an element, a part, a region, a layer and/or a portion in the present specification, but these elements, parts, regions, layers and/or portions are not limited by such terms. Such terms are merely used to differentiate an element, a part, a region, a layer and/or a portion from another element, part, region, layer and/or portion. Therefore, in the following discussions, a first element, portion, region, layer or portion may be called a second element, portion, region, layer or portion, and do not depart from the teaching of the present disclosure.

In addition, relative terms such as "lower" or "bottom" and "on" or "top" may be used to describe the relationship between an element and another element in the present specification, as shown in the FIGs. It should be understood that, the purpose of using relative terms is to include the different directions of the devices not shown in the FIGs. For example, if a device in an attached FIG is turned upside down, an element described as being "under" another element will be "on top" of that element. Therefore, a descriptive term "under" may include the meaning of both "under" and "on top of", depending on the specific orientation of the attached figure.

The terms "about", "approximate" or "essentially" used in the present specification include the value itself and the average values within the acceptable range of deviation of the specific values confirmed by a person having ordinary skill in the present art, considering the specific measurement discussed and the amount of errors related to such measurement (that is, the limitation of the measurement system). For example, "about" may mean within one or more standard deviations of the value itself, or within ±30%, ±20%, ±10%, ±5%. In addition, "about", "approximate" or "essentially" used in the present specification may select a more acceptable range of deviation or standard deviation based on optical property, etching property or other properties. One cannot apply one standard deviation to all properties.

A lock device of the present invention is used in an electronic device (not shown) to be connected to a lock hole (not shown) of the electronic device. The electronic device is preferably portable, such as, but not limited to, a notebook computer, a tablet, a mobile phone, an e-book, a digital photo frame, a GPS navigator, a mobile network device, a personal digital assistant, a digital walkman, and electronic dictionary, etc.

In an embodiment shown in FIG. 1, a lock device 910 of the present invention includes a housing 100, a rotating hook 300, a driving device 700, and a lock body 800. An end of the housing 100 has a front opening 110, and is preferably composed of an upper housing 100' and a lower housing 100". In this embodiment, the rotating hook 300 is disposed in the housing 100, and may rotate relative to the housing 100 along a plane parallel to an X-Y plane, and be scissor-shaped. However, in different embodiments, there may be more than two rotating hooks 300 that are not limited to be scissor-shaped. The rotating hook 300 includes a front-end portion 310 and a rear-end portion 320. The front-end portion 310 at least partially protrudes from the front opening 110, and an end of the front-end portion 310 has a hook portion 311 extending laterally. The rear-end portion 320 extends toward a direction opposite to the front-end portion 310. The driving device 700 is disposed in the housing 100 and may be selectively moved to a first position and a second position along a Z-axis direction, so as to extend by a first depth and a second depth to be between the rear ends 320, respectively, so that the front-end portion 310 is opened by a first width and a second width, respectively. The lock body 800 is disposed in the housing 100. When the lock body 800 is locked, the lock body 800 restricts movement of the driving device 700 along the Z-axis direction. An X axis, the Y axis, and a Z axis are orthogonal. Further, the driving device 700 may be selectively moved, so that a width by which the front-end portion 310 is opened is changed, i.e. the front-end portions 310 moves away from each other to change the distance therebetween. The lock body 800 restricts the movement of the driving device 700.

More particular, in the embodiment shown in FIG. 1, the rotating hook 300 has a first shaft hole 301, and the front-end portion 310 extends from the first shaft hole 301 toward the front opening 110 to protrude from the front opening 110, and the rear-end portion 320 extends from the first shaft hole 301 toward a direction opposite to the front-end portion 310. A first shaft 101 extending along the Z axis is disposed in the housing 100. The rotating hooks 300 are disposed in the housing 100 in a stacked manner, and the first shaft hole 301 is aligned for the first shaft 101 to pass through. In this way, the rotating hooks 300 may be rotated, with the first shaft 101 as an axis, around a plane parallel to the X-Y plane relative to the housing 100. In addition, the stacked rotating hooks 300 are scissor-shaped, that is, the front-end portions 310 intersect, and there is a gap between the rear-end portions 320. Hook portions 311 of the stacked rotating hooks 300 face in opposite directions. When the gap between the rear-end portions 320 is increased, that is, when the rear-end portions 320 are away from each other, the hook portions 311 are also away from each other, so that a width $W_{311}$ occupied by the front-end portions 310 in the X-Y plane direction is increased.

In the embodiment shown in FIG. 1, the driving device 700 includes a driving member 500 and a force applying member 600, and may further include an elastic device 710. The driving member 500 includes a driving member top surface 510, a driving member bottom surface 520, and a second shaft hole 502. The driving member top surface 510 and the driving member bottom surface 520 are located on opposite sides of the driving member 500. The driving member bottom surface 520 orients toward the rotating hook 300 and has a driving portion 521. The driving portion 521 corresponds to a gap between the rear-end portions 320. In other words, a projection of the driving portion 521 on the X-Y plane overlaps with a projection of the gap between the rear-end portions 320 on the X-Y plane. Therefore, when the driving member 500 is moved toward the rotating hook 300 along the Z-axis direction, the driving member 500 may extend into the gap between the rear-end portions 320 to abut against the rear-end portions 320 so as to cause the rear-end portions to be away from each other, thereby causing the hook portions 311 to be away from each other. In a preferred embodiment, the driving portion 521 has a cone shape to apply a force to the rear-end portion 320. A second shaft 102 extending along the Z axis and passing through the second shaft hole 502 is further disposed in the housing 100.

In the embodiment shown in FIG. 1, a guide ramp 530 is disposed on the driving member top surface 510, the guide ramp 530 having a first step 531, a second step 532 and a third step 533. The driving member top surface 510 includes a stop 540 disposed adjacent to a bottom of the guide ramp 530. The driving member top surface 510 has a top surface position 534 between the bottom of the guide ramp 530 and the stop 540. Further, the first step 531, the second step 532, and the third step 533 are located on the guide ramp 530, respectively, and heights relative to the driving member top surface 510 along the Z axis are sequentially reduced, and the top surface position 534 is located on the driving member top face 510.

In the embodiment shown in FIG. 1, the force applying member 600 may rotate relative to the housing 100 along a plane parallel to the X-Y plane, and includes a force applying member top surface 610, a force applying member bottom surface 620, and a third shaft hole 602. More particular, the force applying member 600 may be rotated, with the third shaft hole 602 as an axis, around a plane parallel to the X-Y plane relative to the housing 100. The force applying member 600 is preferably disc-shaped. The force applying member top surface 610 and the force applying member bottom surface 620 are located on opposite sides of the force applying member 600. The force applying member bottom surface 620 orients toward the driving member 500 and has a force applying unit 621. The force applying unit 621 may be moved to correspond to the guide ramp 530 or the top surface position 534. In other words, the force applying unit 621 may be moved so that a projection on the X-Y plane overlaps with a projection of the guide ramp 530 or the top surface position 534 on the X-Y plane.

The driving member 500 and the force applying member 600 are disposed in the housing 100 in a stacked manner, and the second shaft hole 502 is preferably aligned with the third shaft hole 602. The elastic device 710 is disposed between the driving member 500 and an inner wall of the housing 100, and is configured to apply an elastic force to cause the driving member 500 to abut against the force applying member 600. More particular, the elastic device 710 applies an elastic force to cause the driving member top surface 510 to abut against force applying unit 621. When the force applying member 600 rotates relative to the housing 100 along a plane parallel to the X-Y plane, a position of the force applying unit 621 on the guide ramp 530 is changed, so that the driving member 500 moves along the Z-axis direction. Therefore, by rotating the force applying member 600, the driving member 500 may be moved along the Z-axis direction. In other words, the force applying member 600 may be rotated to cause the driving member 500 to move to a specific position, so that the driving portion 521 extends by a specific depth to be between rear-end portions 320, and the front-end portion 310 is opened by a specific width.

The lock device 910 further includes a force bearing member 650 disposed outside the housing 100 for receiving an external force to operate the force applying member 600. More particular, the force bearing member 650 includes a connecting shaft 651 passing through the housing 100 and engaged with the third shaft hole 602. Accordingly, when the force bearing member 650 receives an external force to be rotated, the force applying member 600 may be driven to rotate, with the third shaft hole 602 as an axis, relative to the housing 100 along a plane parallel to the X-Y plane. However, in different embodiments, the force bearing member 650 may not be disposed, and the force applying member 600 is configured to directly receives the external force. For example, a hollow groove may be disposed on a side of the housing 100, and a periphery of the force applying member 600 at least partially protrudes from the hollow groove for receiving an external force.

In an embodiment shown in FIG. 1, the lock body 800 is disposed in the housing 100. More particular, a braking element 810 is disposed at an end of the lock body 800. In this embodiment, the lock body 800 is a key lock. The other end that is of the lock body 800 and that is relative to the end provided with the braking element 810 has a key hole 820 exposed at a rear opening 120 of the housing 100, for a key 888 to be inserted to operate the lock body 800. However, in different embodiments, the lock body 800 may be a combination lock or other lock bodies without the key hole 820, and the housing 100 may not have the rear opening 120.

In an embodiment shown from 2A to 2E, when the lock body 800 is locked, the braking element 810 extends out of the lock body 800 toward the force applying member 600 and is engaged with the force applying member 600 so as to restrict the rotation of the force applying member 600, thereby restricting a movement of the driving device 700 along the Z-axis direction, and further restricting the rotation of the rotating hook 300. In an embodiment shown from 3A to 3E, when the lock body 800 is unlocked, the braking element 810 is not engaged with the force applying member 600, the force applying member 600 may rotate, and the driving device 700 may move along the Z-axis direction.

In an embodiment shown from 3A to 3E, the braking element 810 has a fixing hole 818, and a periphery of the force applying member 600 has fixing portions such as a first fixing portion 681, a second fixing portion 682, a third fixing portion 683, and a fourth fixing portion 684. When the lock body 800 is locked, the braking element 810 extends out of the lock body 800 toward the force applying member 600 and is engaged with the force applying member 600, and further causes one of the first fixing portion 681, the second fixing portion 682, the third fixing portion 683, and the fourth fixing portion 684, etc. to be inserted into the fixing hole 818. Accordingly, not only the rotation of the force applying member 600 is restricted, but also a function of accurate positioning is provided.

Actuation of the lock device 910 is further illustrated below.

Figure 2A:
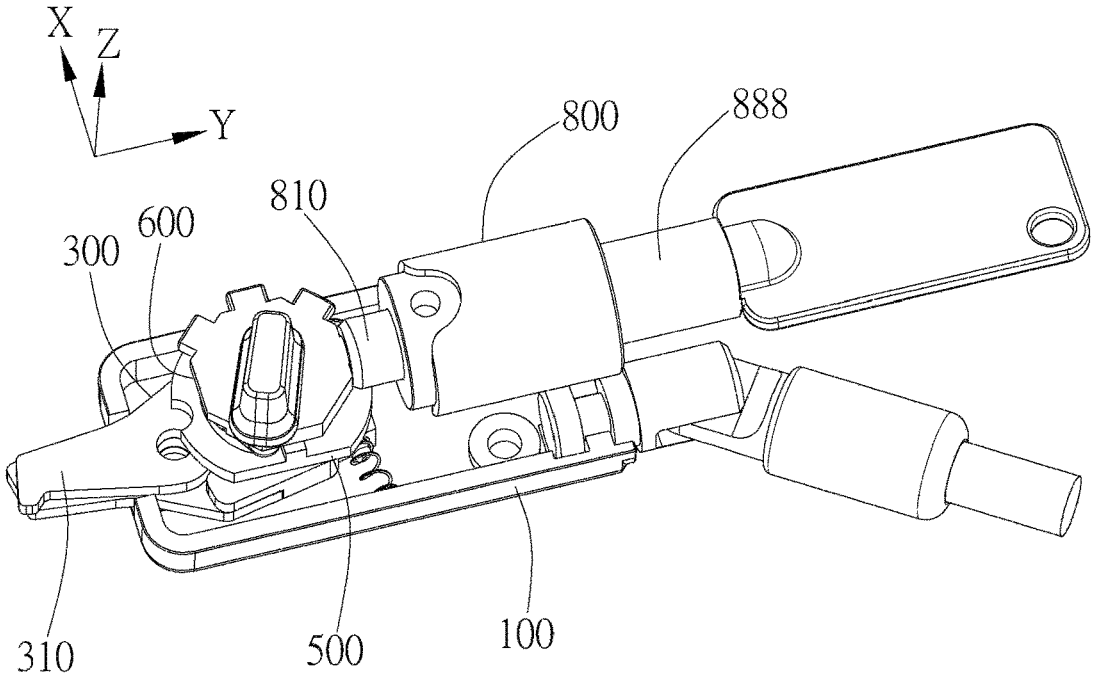
FIGS. 2A to 2F are perspective views showing the force applying member rotated to the top surface position to abut against the force applying unit of the present invention.
Figure 2B:
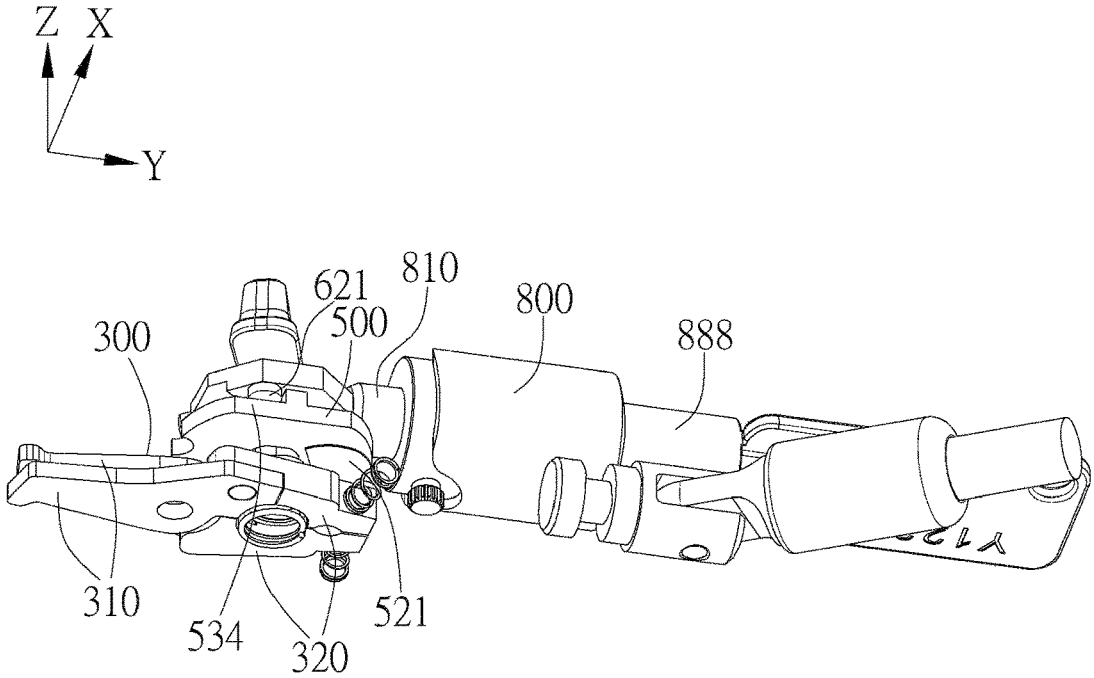
Figure 2C:
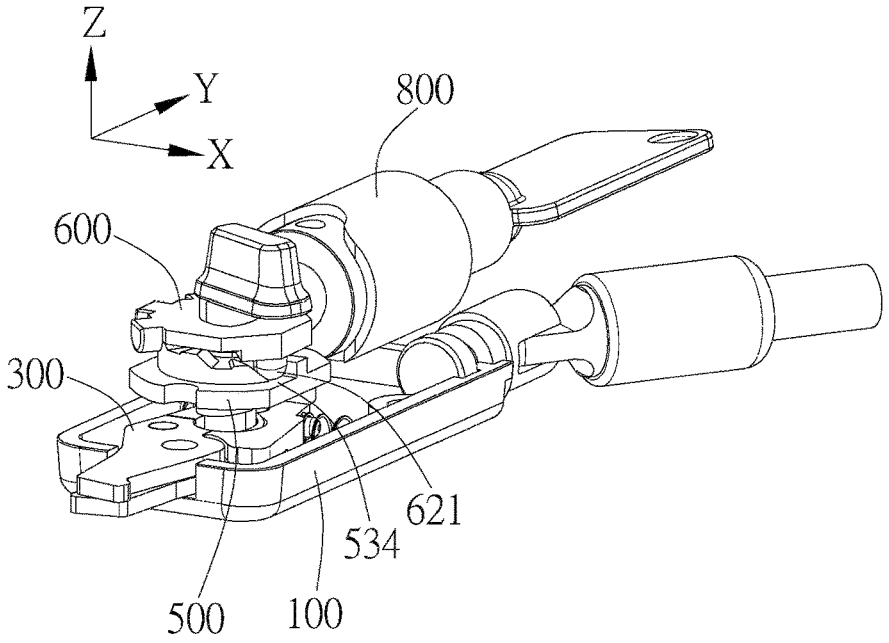
Figure 2D:
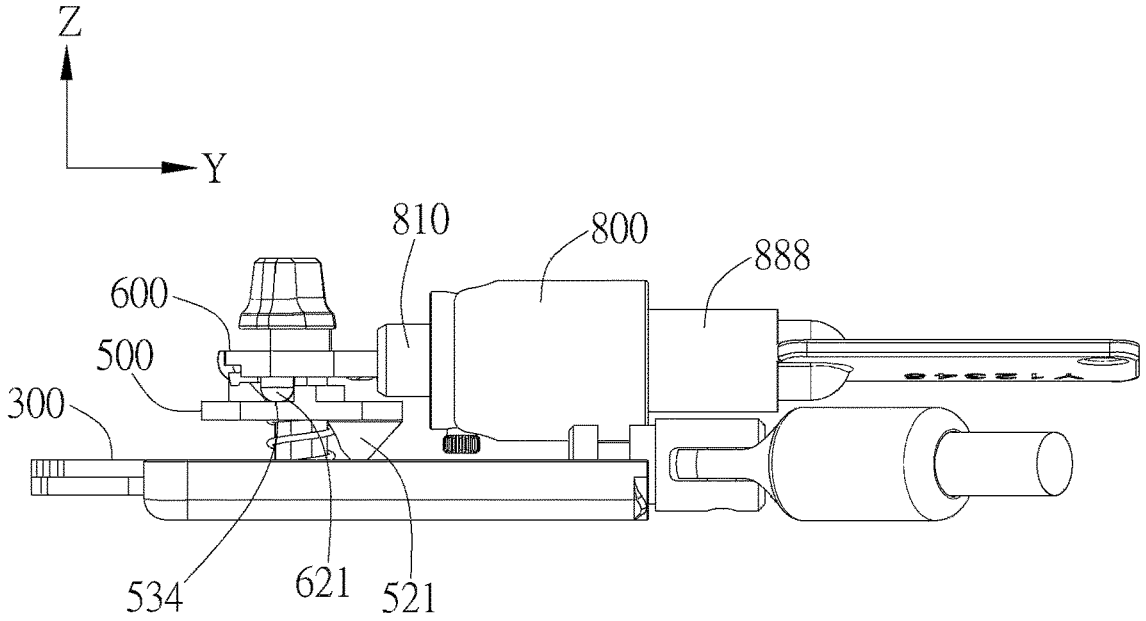
Figure 2E:
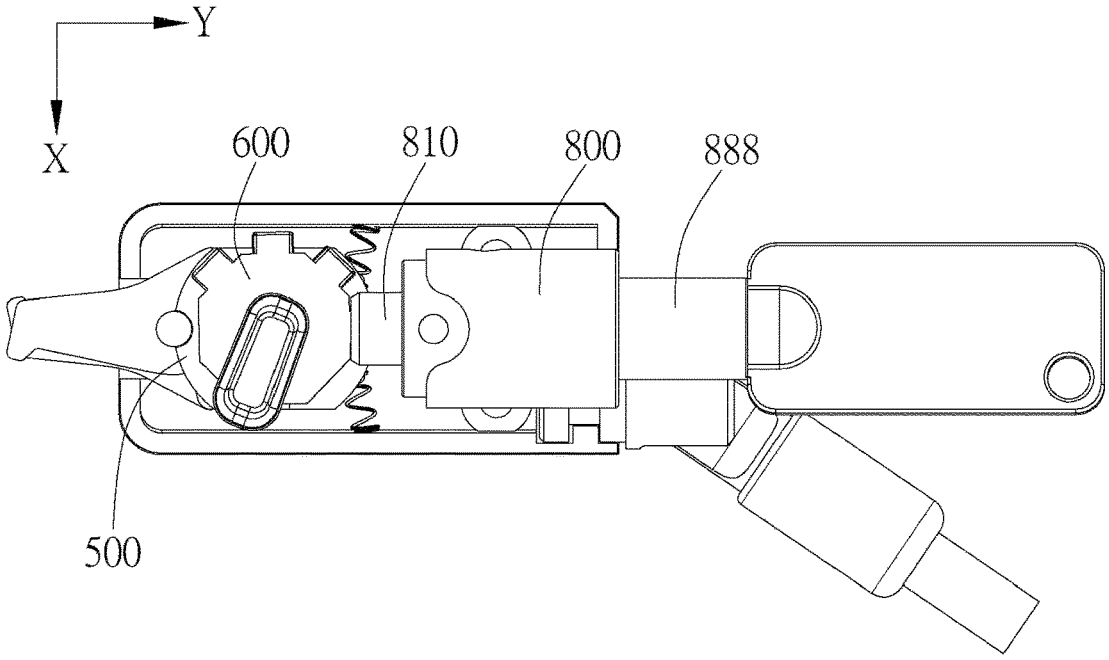
Figure 2F:
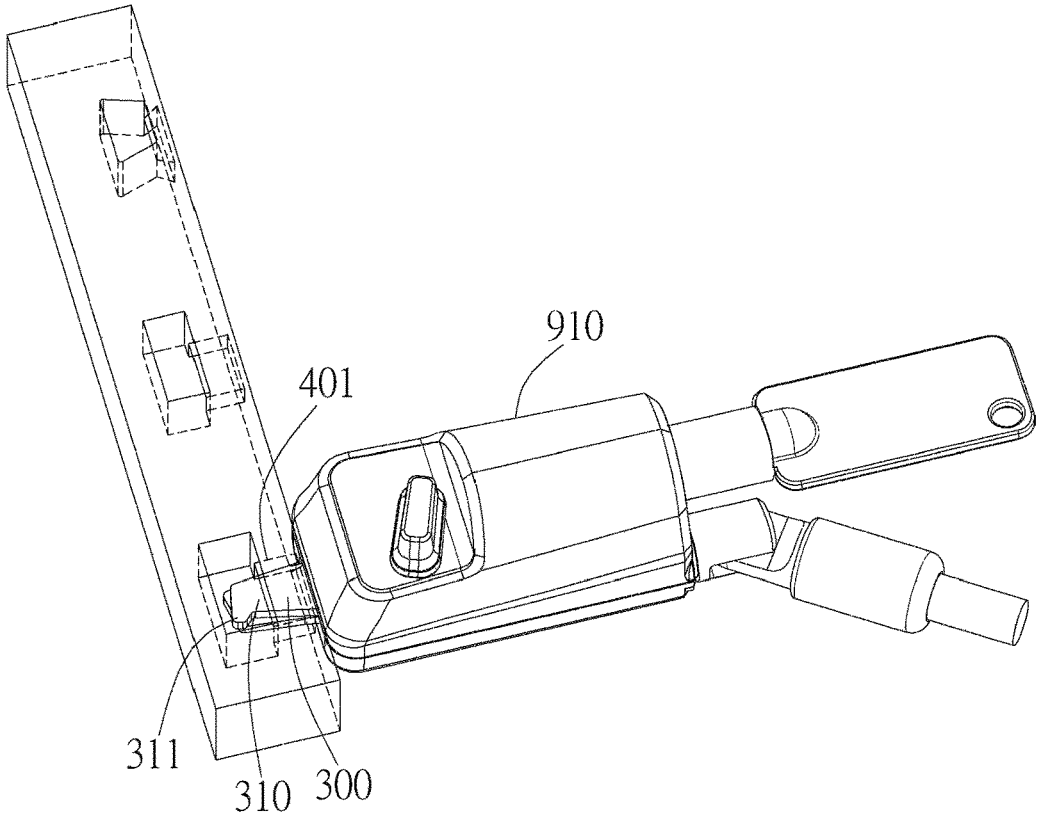
Figure 3A:
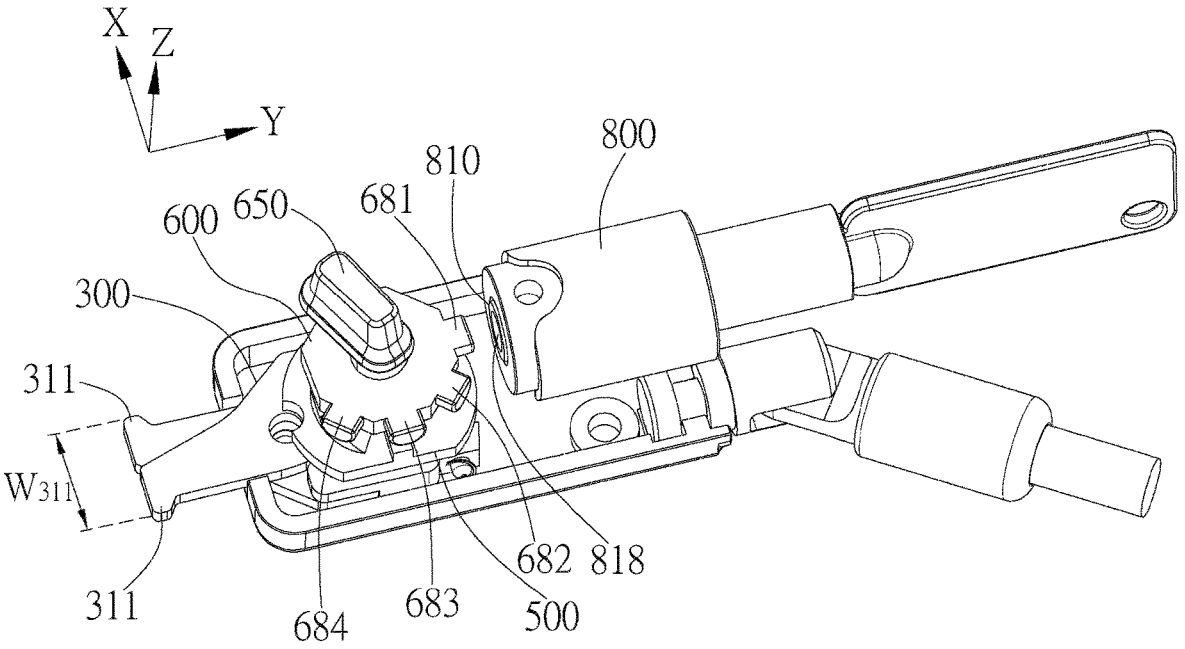
FIGS. 3A to 3E are perspective views showing the force applying member rotated to the first step to abut against the force applying unit, wherein the braking element isn't engaged with the force applying member.
Figure 3B:
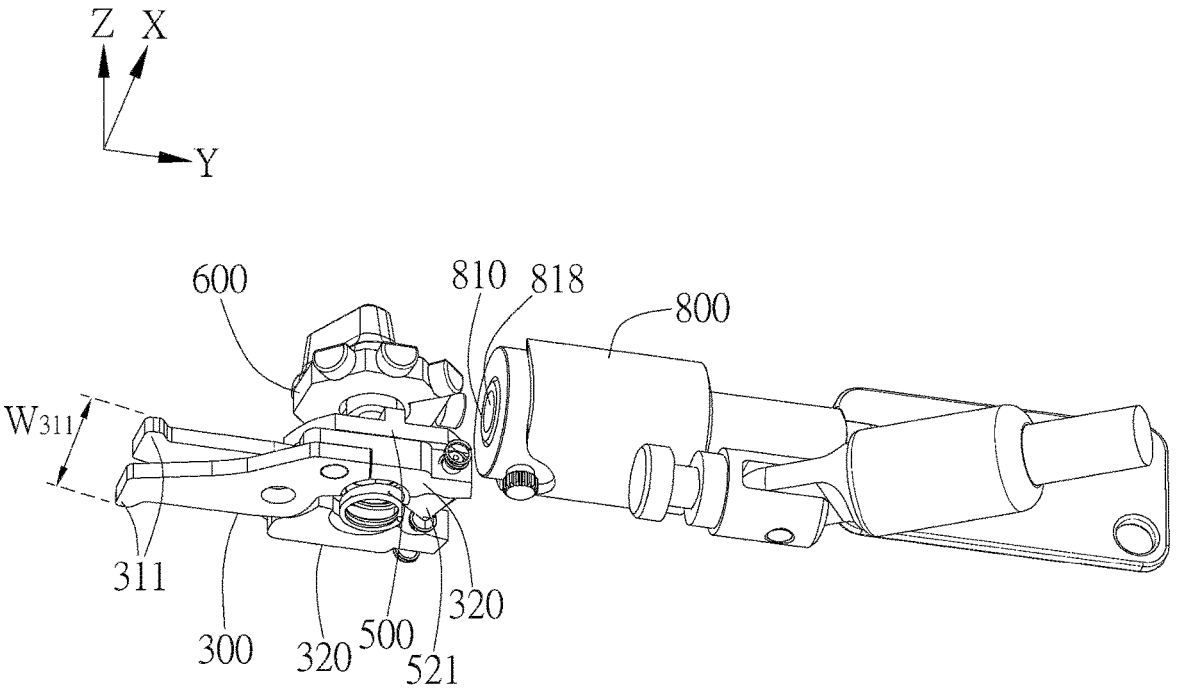
Figure 3C:
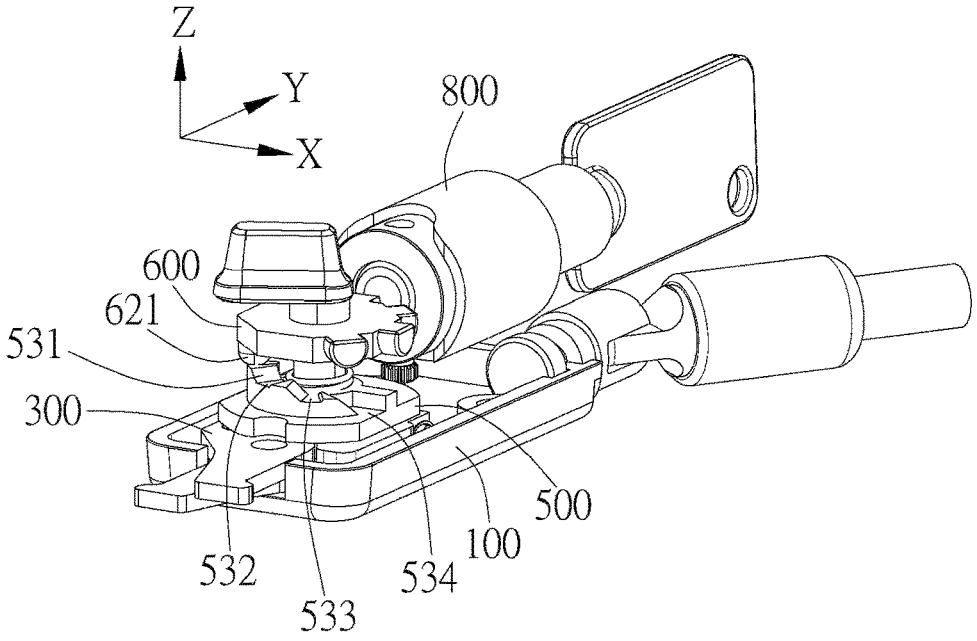
Figure 3D:
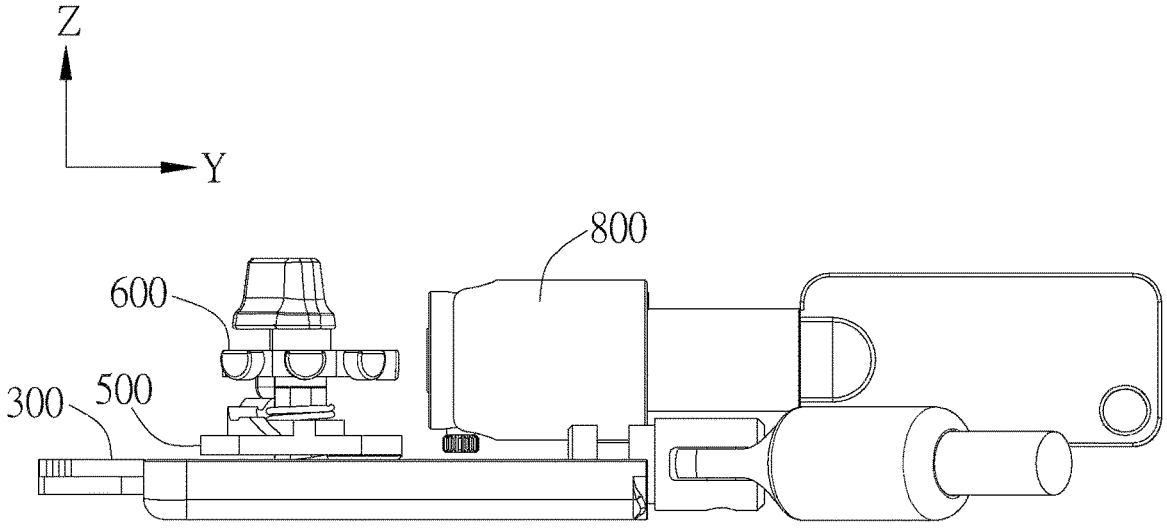
Figure 3E:
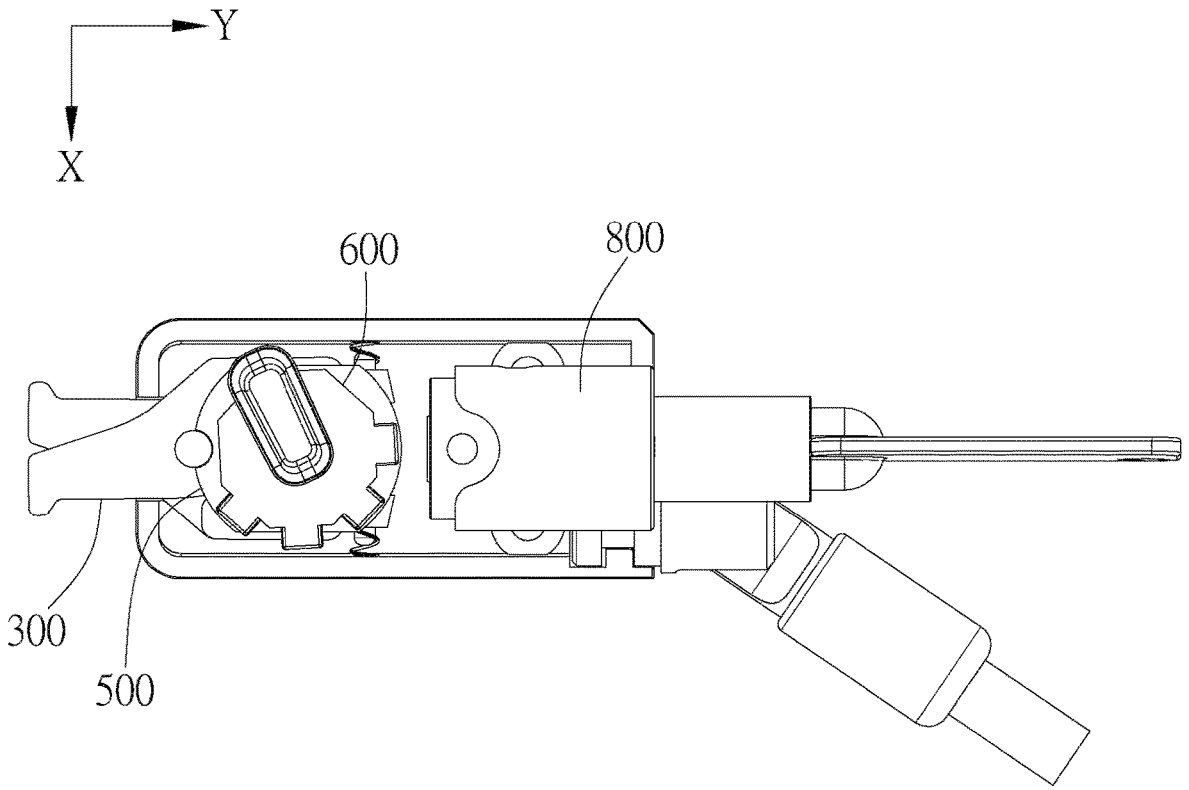

In the embodiment shown from FIG. 2A to FIG. 2E, when the force applying member 600 is rotated to the top surface position 534 to abut against the force applying unit 621, a depth by which the driving portion 521 extends between the end portions 320 is zero or at least insufficient to cause the front-end portion 310 to open by a certain width. In this case, as shown in FIG. 2F, because the hook portions 311 do not interfere with a side wall of the lock hole 401, the rotating hook 300 of the lock device 910 may enter the lock hole 401.

Figure 4A:
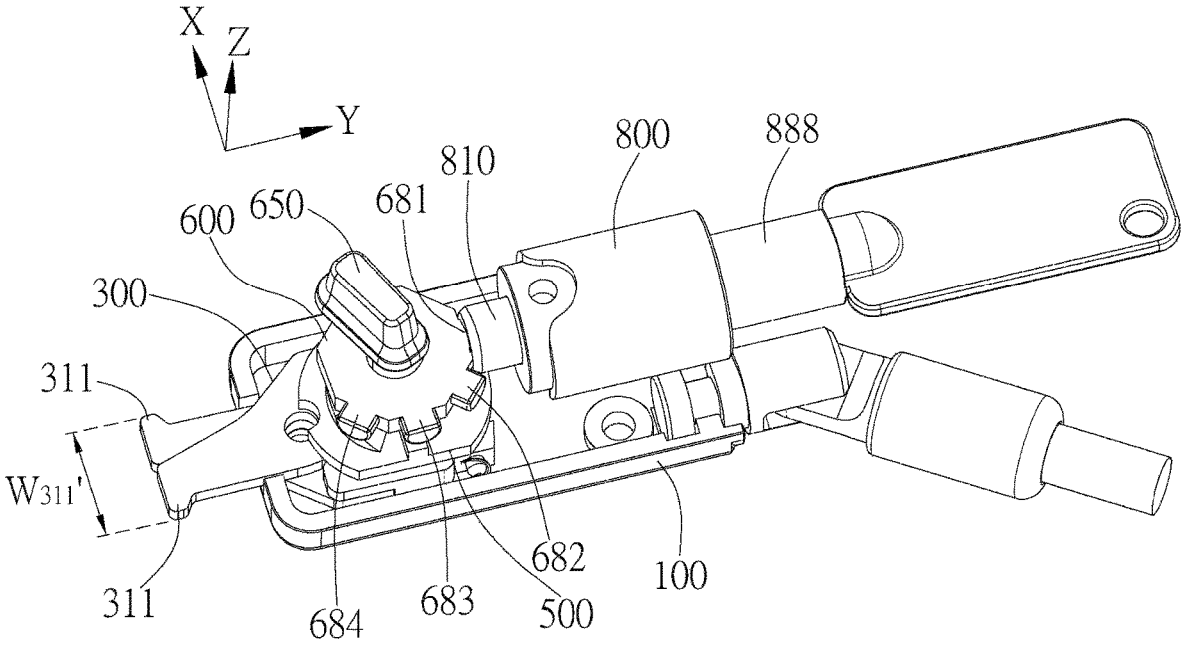
FIGS. 4A to 4F are perspective views showing the force applying member rotated to the first step to abut against the force applying unit, wherein the braking element is engaged with the force applying member.
Figure 4B:
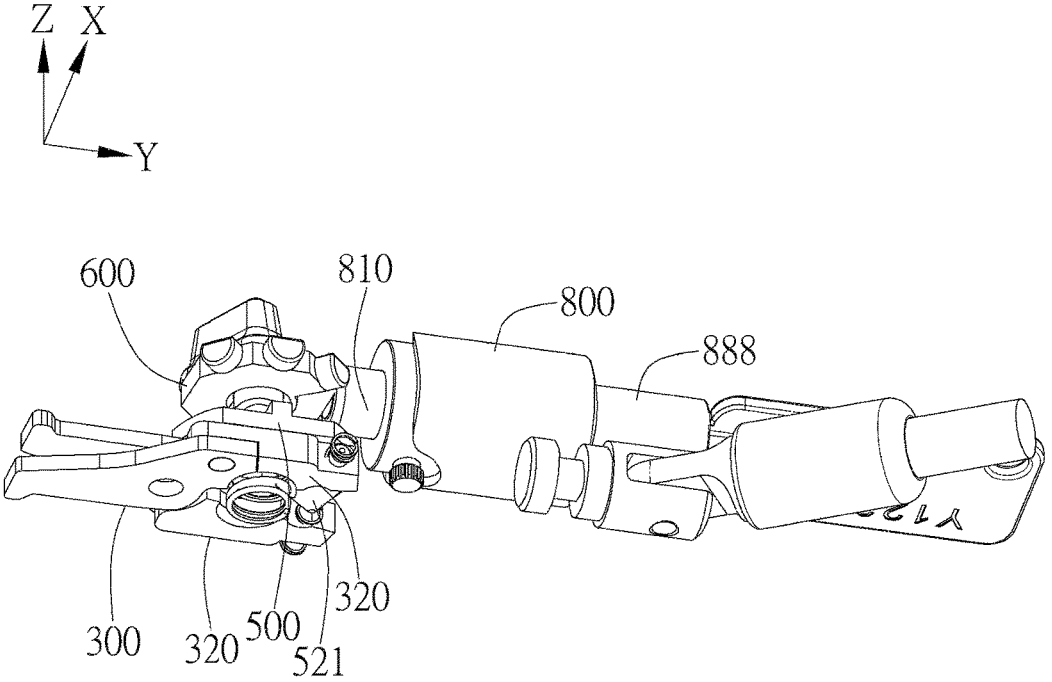
Figure 4C:
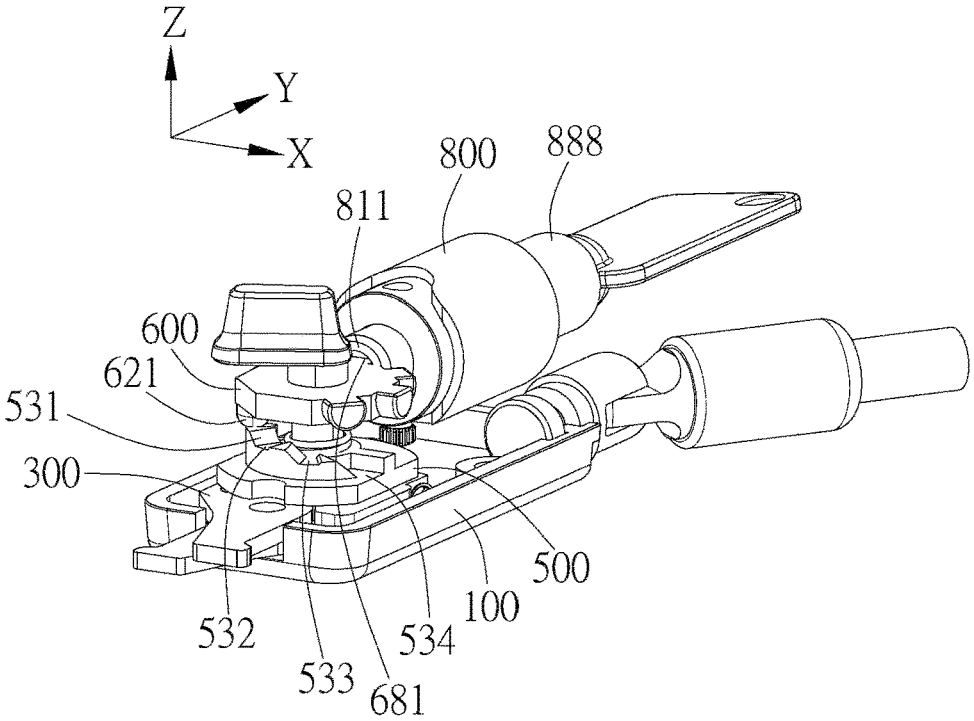
Figure 4D:
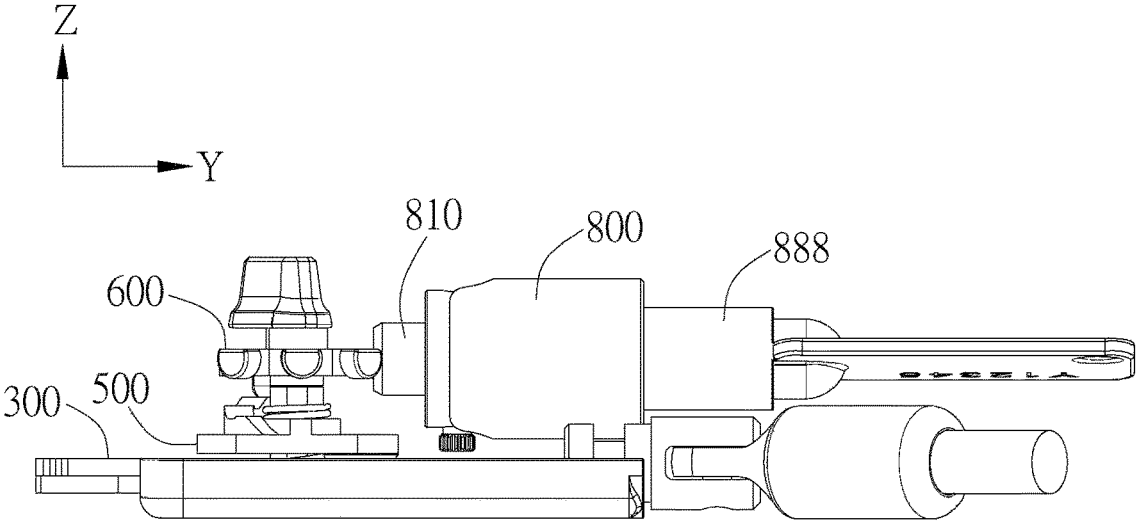
Figure 4E:
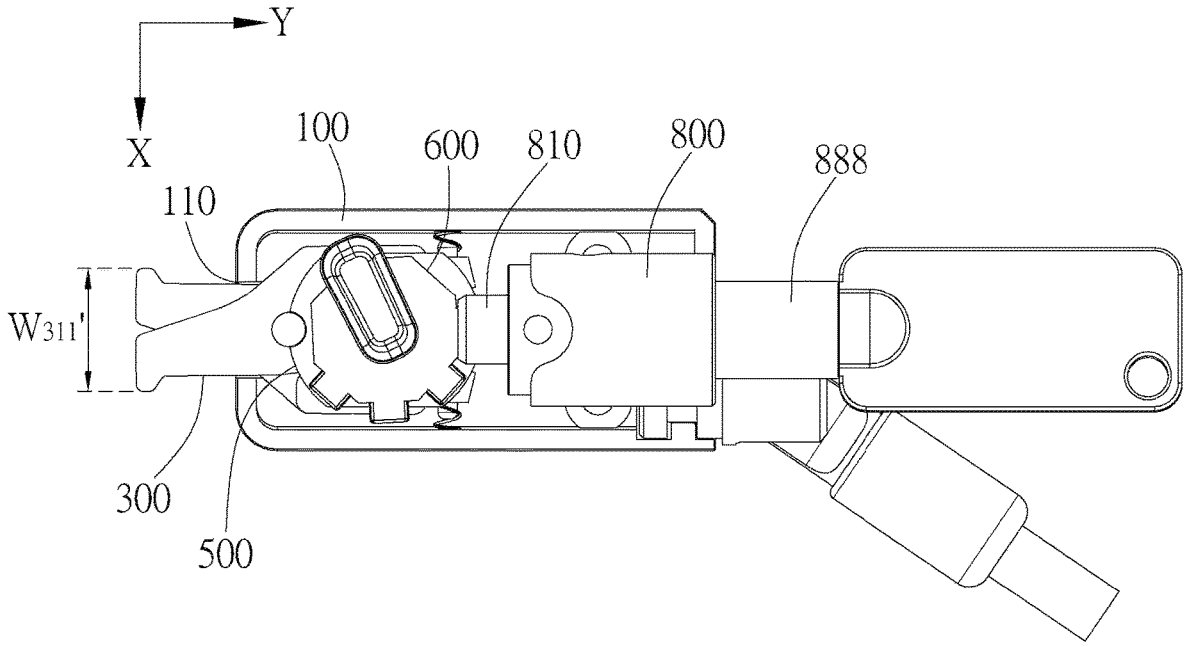
Figure 4F:
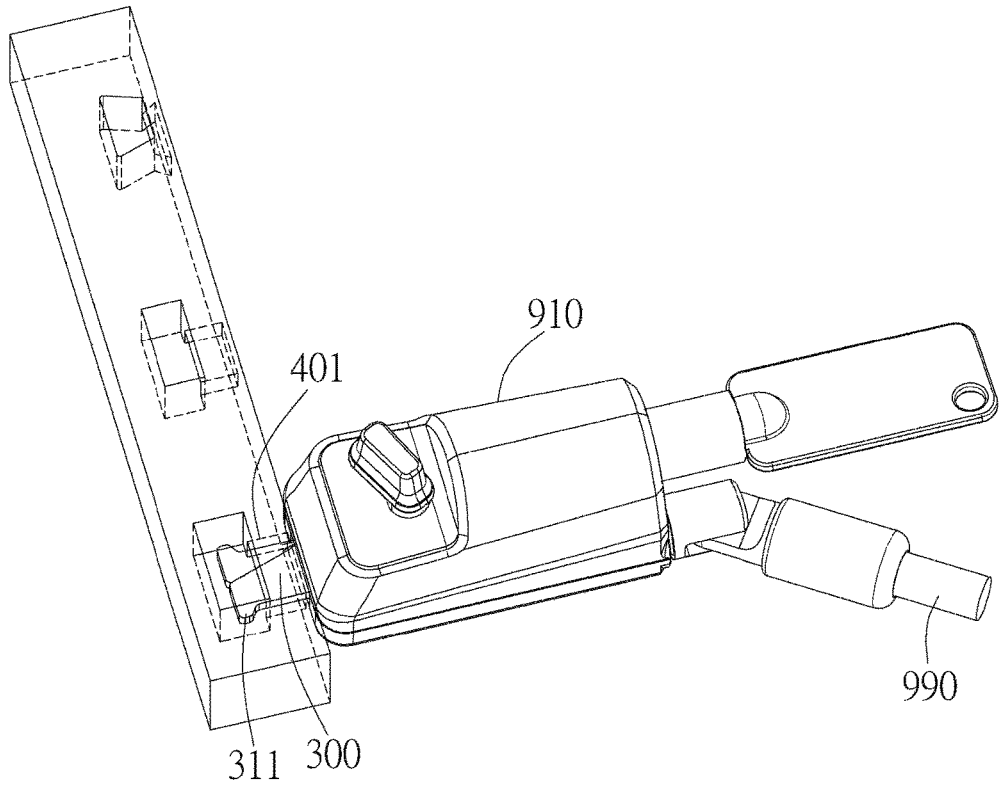

Afterwards, in the embodiment shown from FIG. 3A to FIG. 3E, when the lock body 800 is unlocked, the force applying member 600 is rotated to the first step 531 to abut against the force applying unit 621, the driving device 700 is moved along the Z-axis direction to cause the driving portion 521 to extend between the rear ends 320, thereby causing the front-end portion 310 to be opened by a width $W_{311'}$. In this case, the first fixing portion 681 orients toward the fixing hole 818. Next, in an embodiment shown from FIG. 4A to FIG. 4E, a key 888 is rotated to cause a lock body 800 to be locked, and a braking element 810 protrudes from the lock body 800 toward a force applying member 600 and is engaged with the force applying member 600. More particular, the first fixing portion 681 is inserted into the fixing hole 818. In this case, a rotation of the force applying member 600 is restricted, thereby restricting a movement of a driving device 700 along a Z-axis direction, and further restricting a rotation of a rotating hook 300. Accordingly, in the embodiment shown in FIG. 4F, the hook portions 311 interfere with a side wall of a lock hole 401 to cause a movement of the rotating hook 300 of the lock device 910 to be prevented from leaving the lock hole 401, and the lock device 910 is locked in the lock hole 401. The housing 100 is further connected to a flexible chain 990 to fix the lock device 910 together with an electronic device having the lock hole 401 to a specific object, such as a table.

Figure 5A:
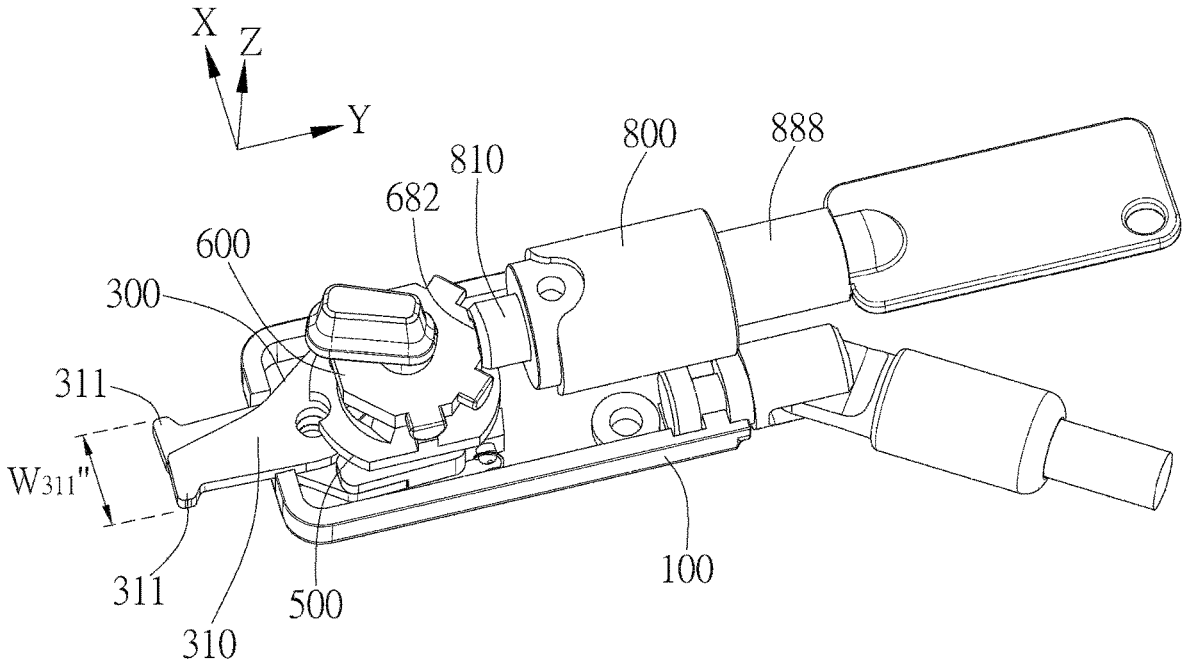
FIGS. 5A to 5F are perspective views showing the force applying member rotated to the second step to abut against the force applying unit, wherein the braking element is engaged with the force applying member.
Figure 5B:
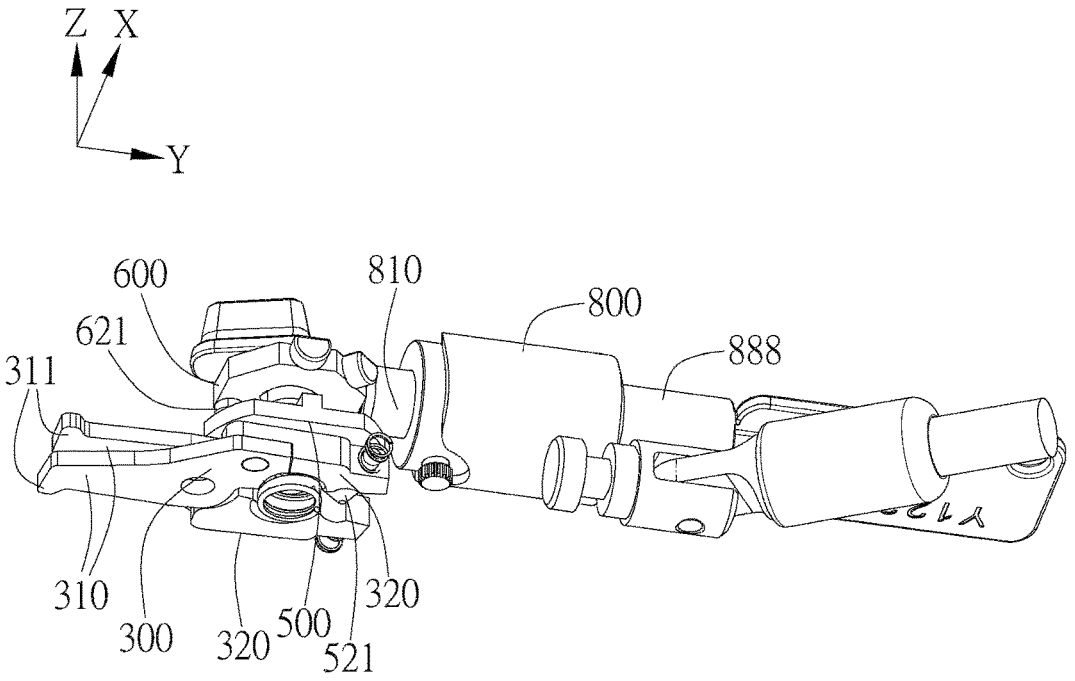
Figure 5C:
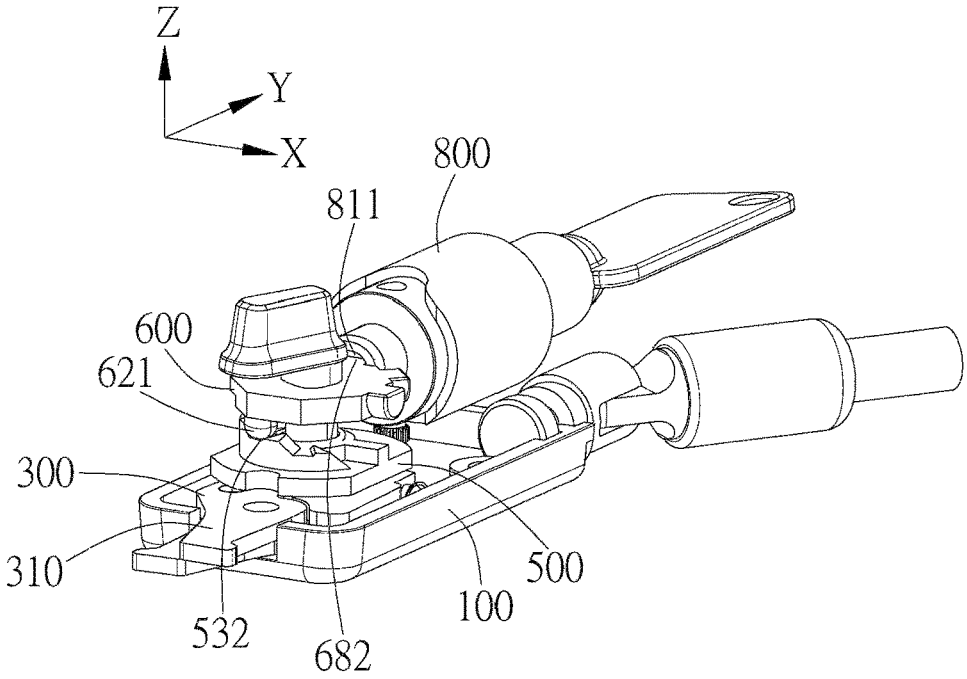
Figure 5D:
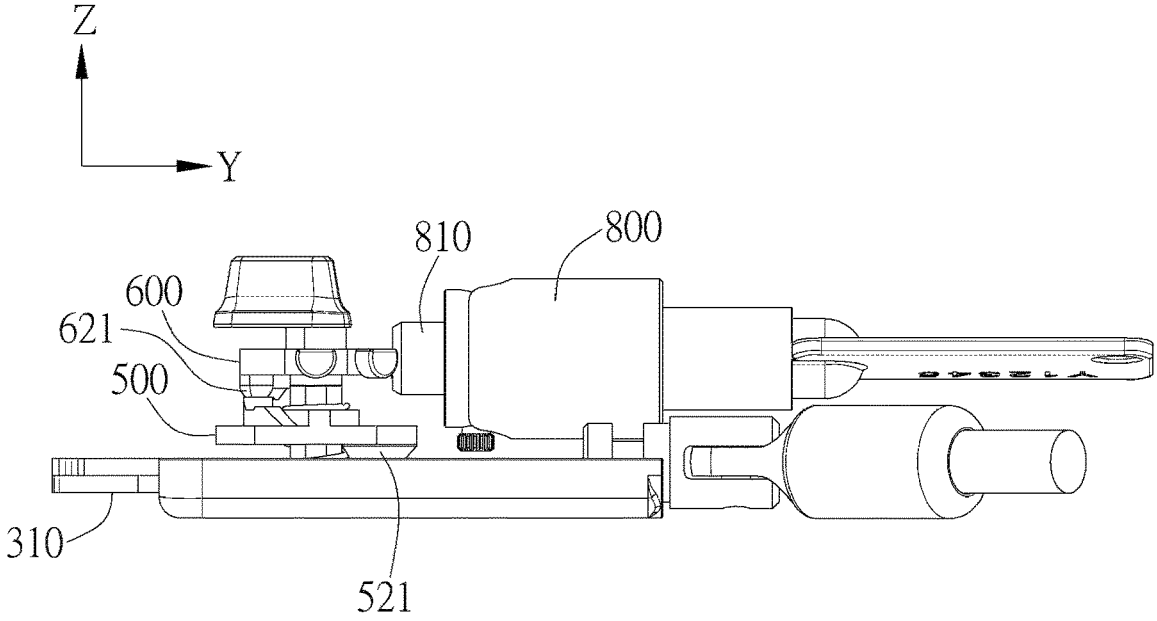
Figure 5E:
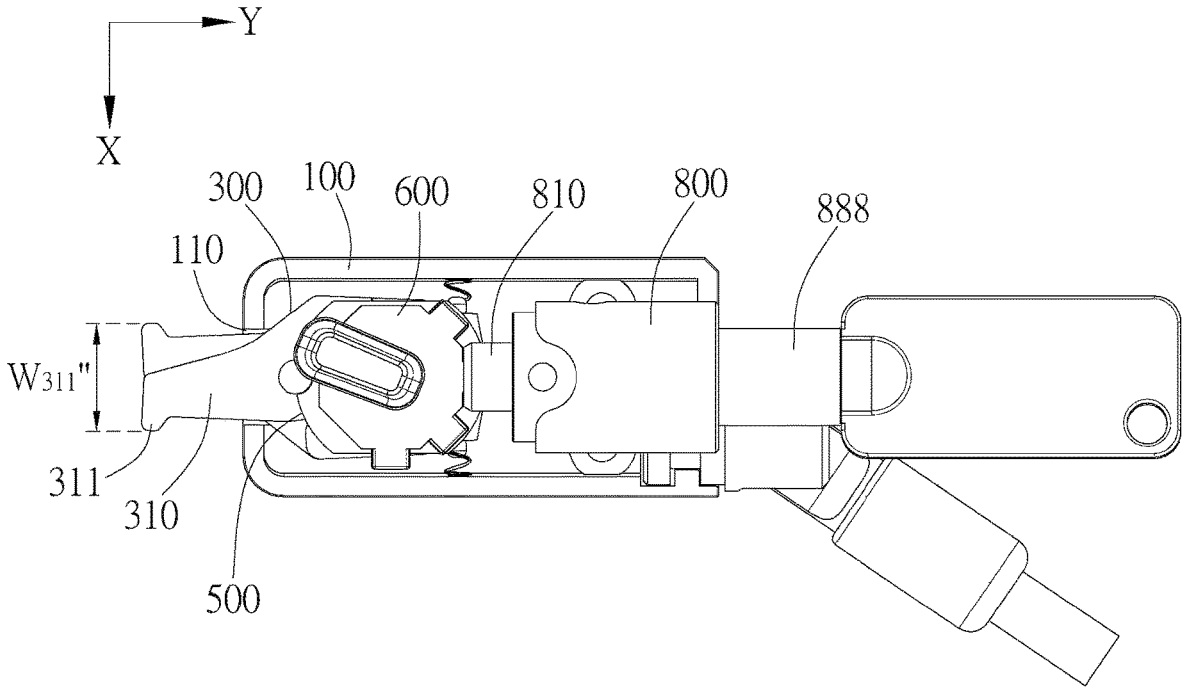
Figure 5F:
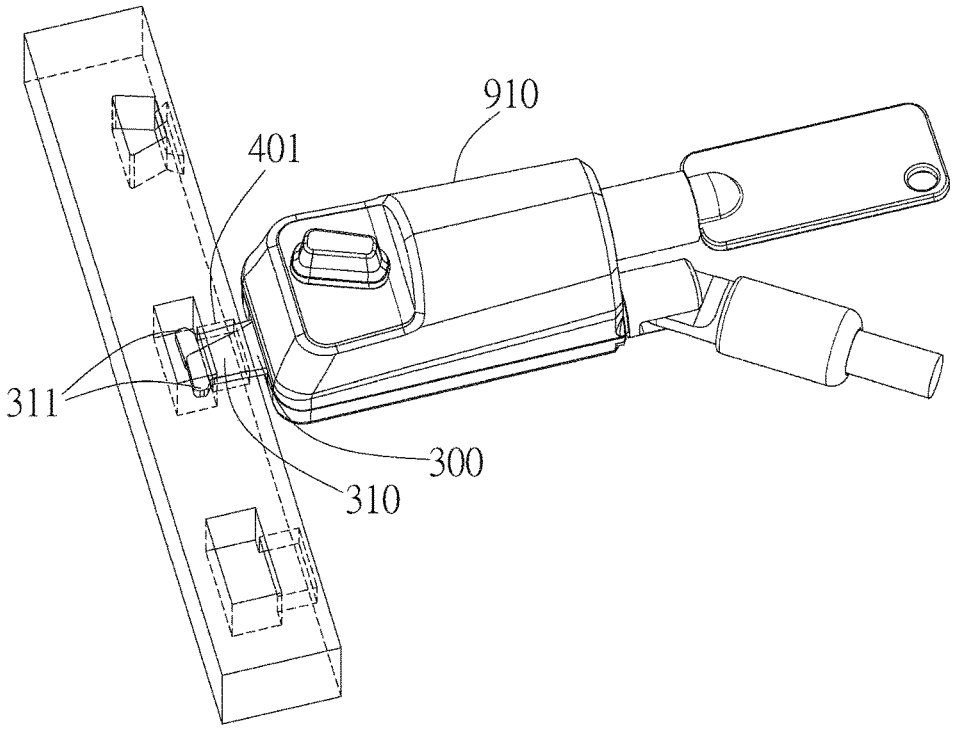

After the lock body 800 is unlocked, the force applying member 600 returns to a rotatable state, and in the embodiment shown from FIG. 2A to FIG. 2E, the force applying member 600 is rotated to the top surface position 534 to abut against the force applying unit 621. Next, the rotating hook 300 of the lock device 910 is inserted into the lock hole 402 (see FIG. 5F). The lock hole 402 is smaller than the lock hole 401. Afterwards, in an embodiment shown from FIG. 5A to FIG. 5E, a force applying member 600 is rotated to a second step 532 to abut against a force applying unit 621, and a driving device 700 is moved along a Z-axis direction to cause a driving portion 521 to extend between the rear-end portions 320, thereby causing the front-end portion 310 to open by a width of $W_{311''}$, and causing a second fixing portion 682 to orient toward the fixing hole 818. In addition, a key 888 is turned to lock the lock body 800, and a braking element 810 protrudes from the lock body 800 toward the force applying member 600 and is engaged with the force applying member 600. More particular, the second fixing portion 682 is inserted into the fixing hole 818. In this case, a rotation of the force applying member 600 is restricted, thereby restricting a movement of a driving device 700 along a Z-axis direction, and further restricting a rotation of a rotating hook 300. Accordingly, in the embodiment shown in FIG. 5F, the hook portions 311 interfere with a side wall of a lock hole 402 to cause a movement of the rotating hook 300 of the lock device 910 to be prevented from leaving the lock hole 402, and the lock device 910 is locked in the lock hole 402.

Figure 6A:
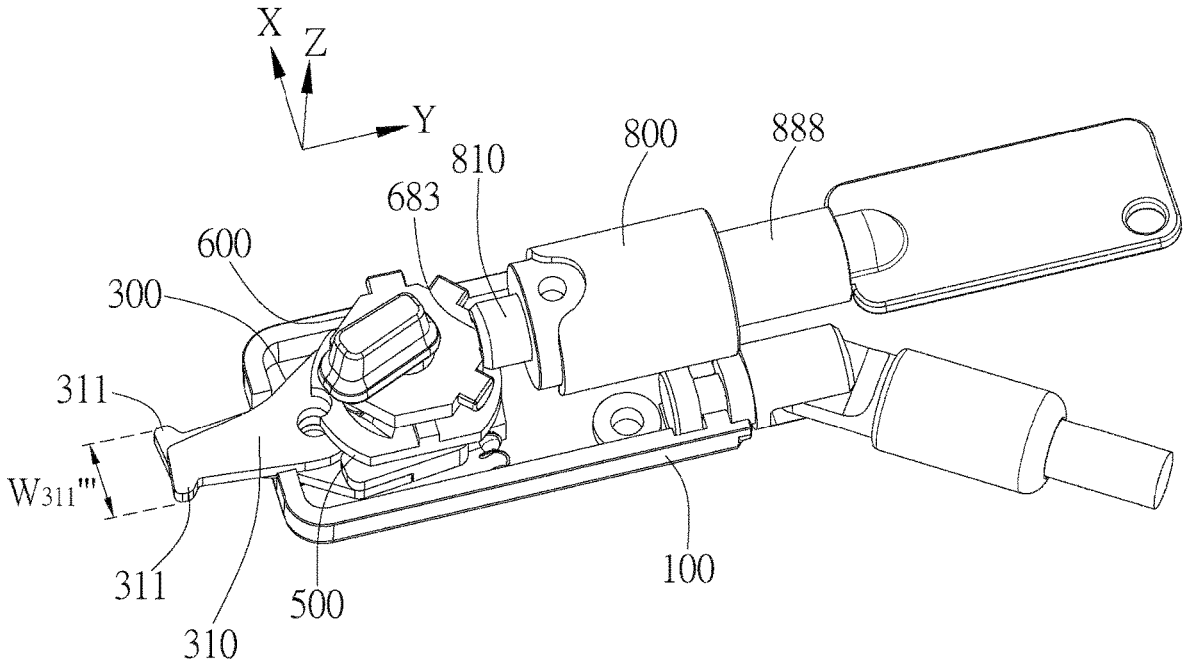
FIGS. 6A to 6F are perspective views showing the force applying member rotated to the first step to abut against the force applying unit, wherein the braking element is engaged with the force applying member.
Figure 6B:
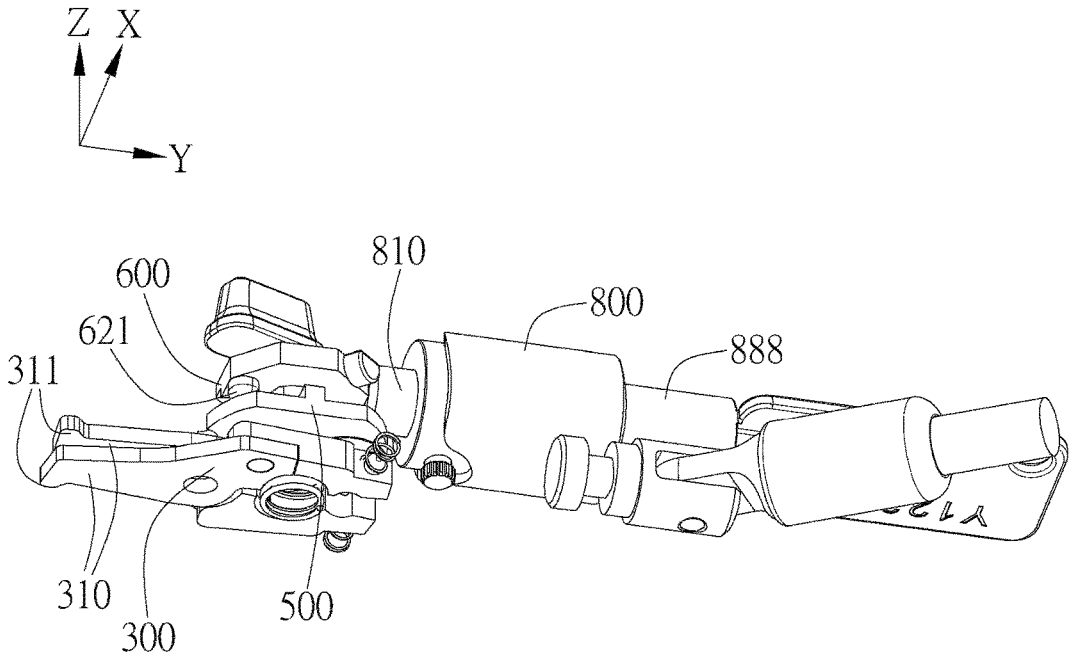
Figure 6C:
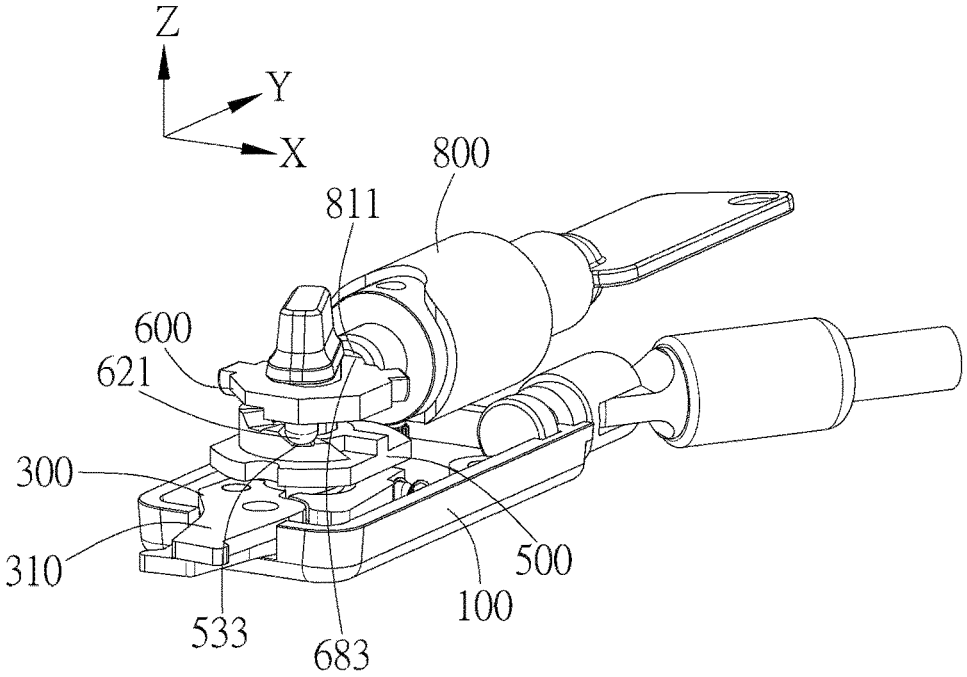
Figure 6D:
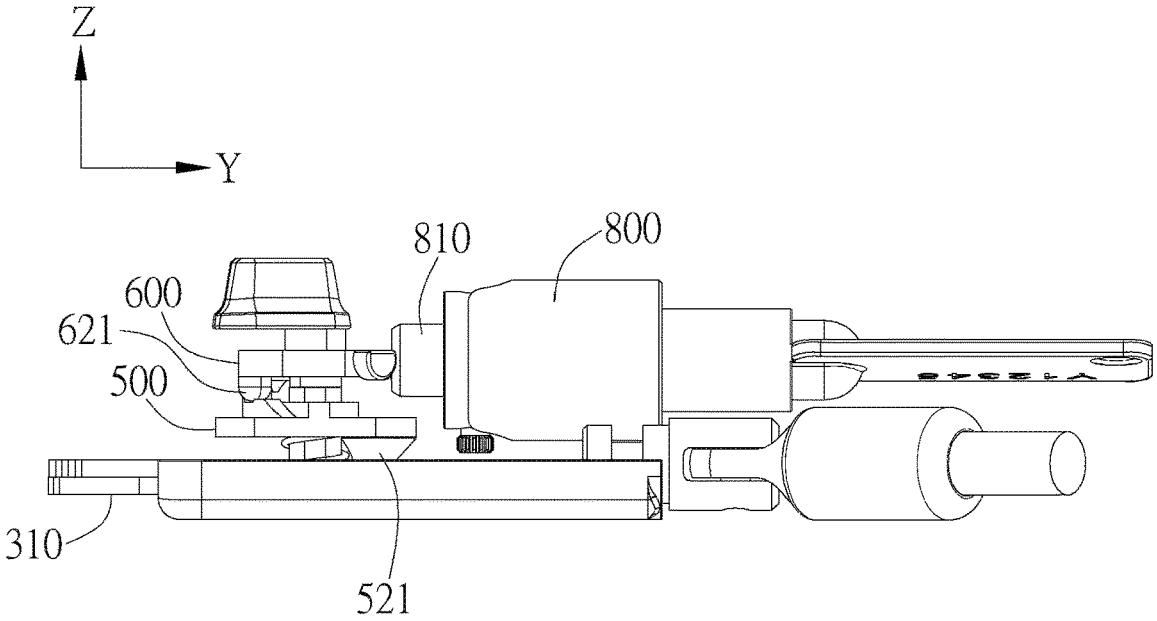
Figure 6E:
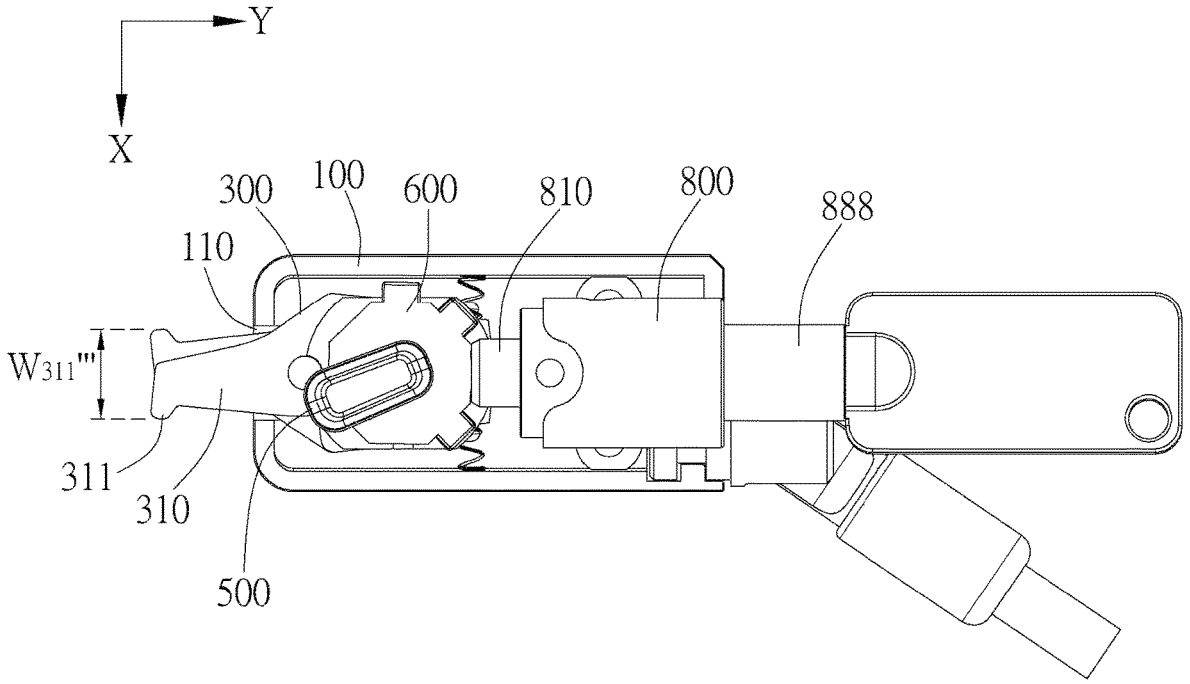
Figure 6F:
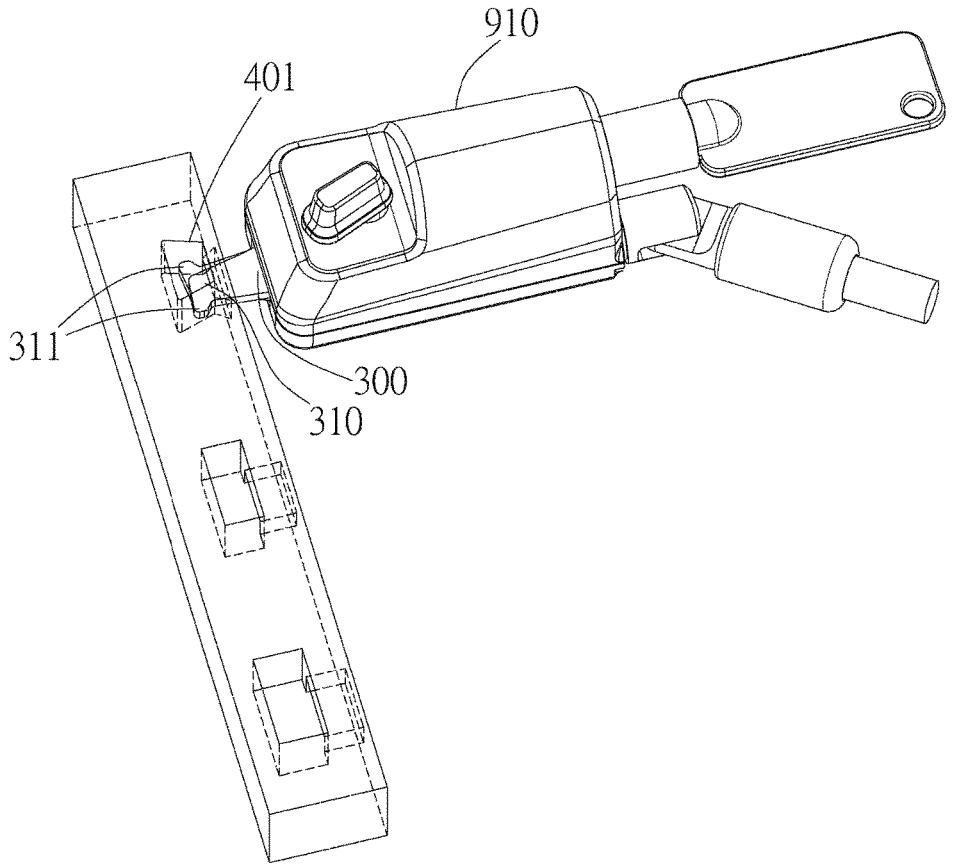

After the lock body 800 is unlocked, the force applying member 600 returns to a rotatable state, and in the embodiment shown from FIG. 2A to FIG. 2E, the force applying member 600 is rotated to the top surface position 534 to abut against the force applying unit 621. Next, the rotating hook 300 of the lock device 910 is inserted into the lock hole 403 (see FIG. 6F). The lock hole 403 is smaller than the lock hole 402. Afterwards, in an embodiment shown from FIG. 6A to FIG. 6E, a force applying member 600 is rotated to a third step 533 to abut against a force applying unit 621, and a driving device 700 is moved along a Z-axis direction to cause a driving portion 521 to extend between the rear-end portions 320, thereby causing the front-end portion 310 to open by a width of $W_{311''}$, and causing a third fixing portion 683 to orient toward the fixing hole 818. In addition, a key 888 is turned to lock the lock body 800, and a braking element 810 protrudes from the lock body 800 toward the force applying member 600 and is engaged with the force applying member 600. More particular, the third fixing portion 683 is inserted into the fixing hole 818. In this case, a rotation of the force applying member 600 is restricted, thereby restricting a movement of a driving device 700 along a Z-axis direction, and further restricting a rotation of a rotating hook 300. Accordingly, in the embodiment shown in FIG. 6F, the hook portions 311 interfere with a side wall of a lock hole 403 to cause a movement of the rotating hook 300 of the lock device 910 to be prevented from leaving the lock hole 403, and the lock device 910 is locked in the lock hole 403.

Based on the foregoing, the lock device 910 of the present invention may be used for lock holes of different sizes, so that a convenience in use may be increased. In addition, in different embodiments, the driving device may be designed in different manners according to manufacturing, design, or use requirements.

Figure 7:
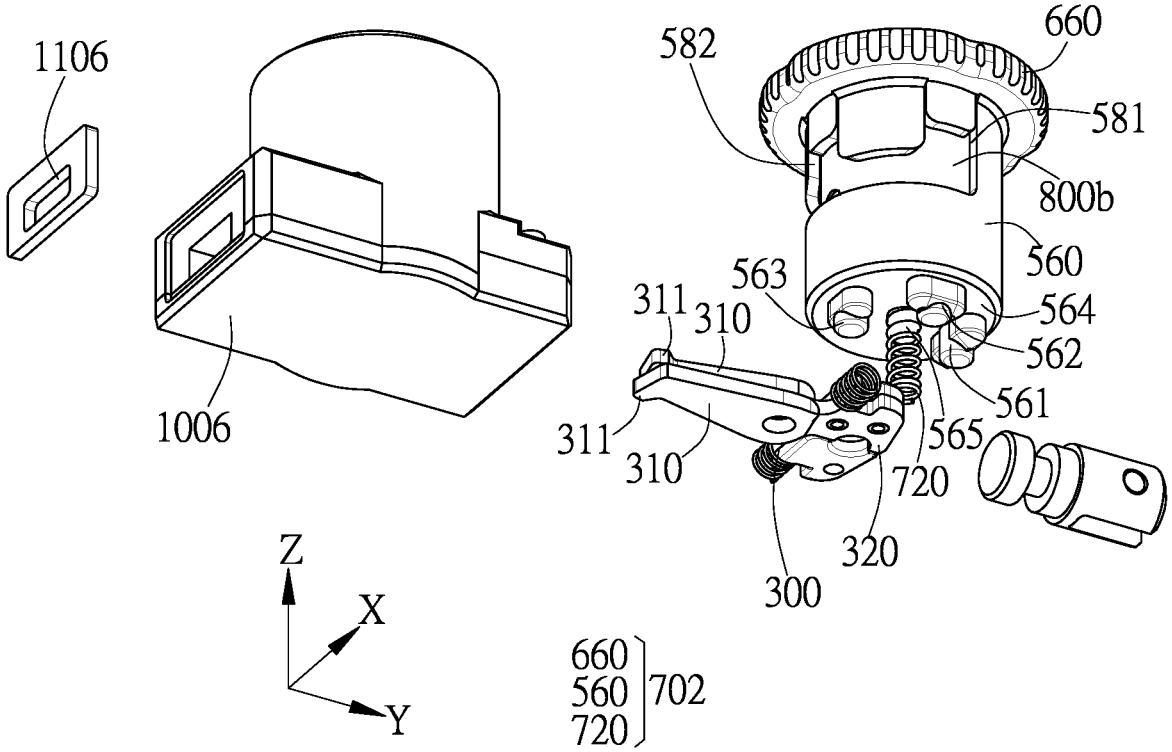
FIG. 7 is exploded view of different embodiment of the lock device of the present invention.
Figure 8A:
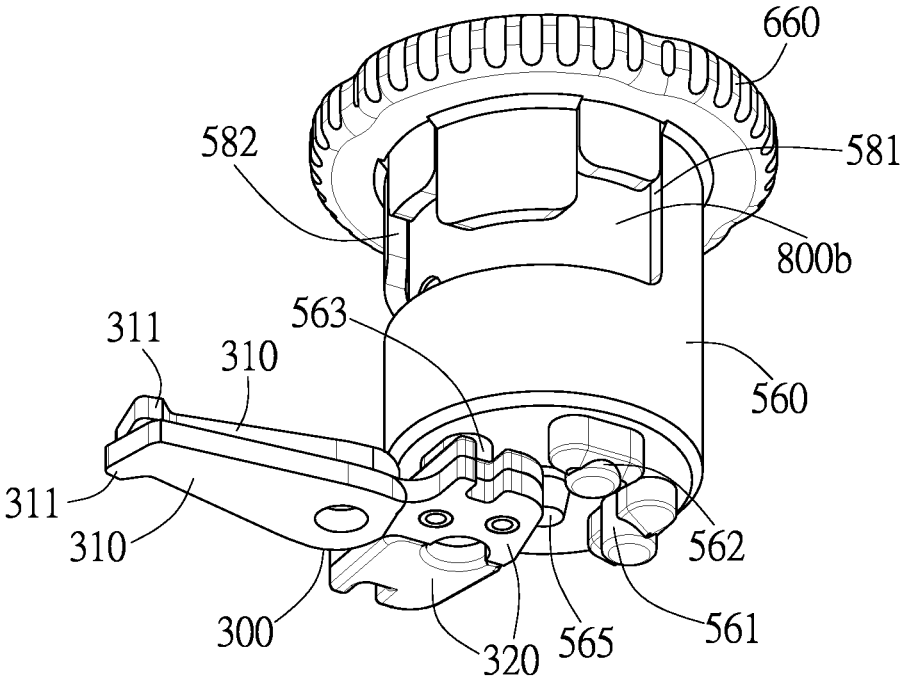
FIGS. 8A to 8D are perspective views showing the driving member not moving downward along the Z axis.
Figure 8B:
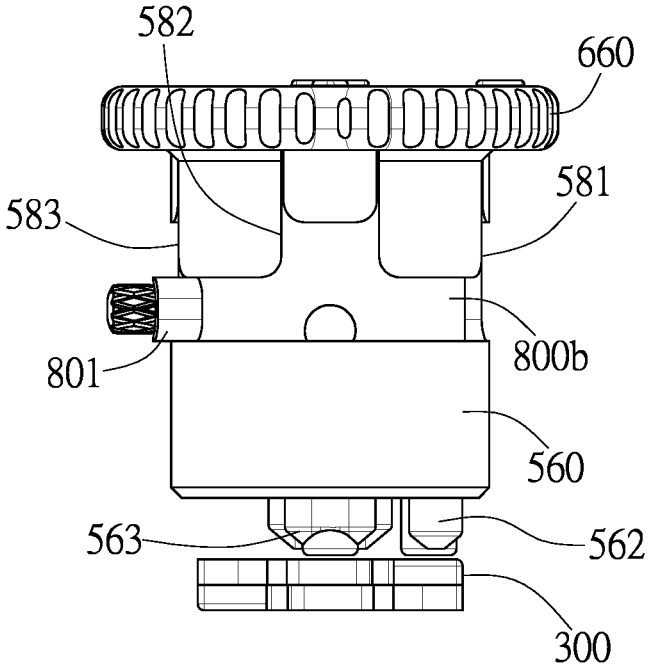
Figure 8C:
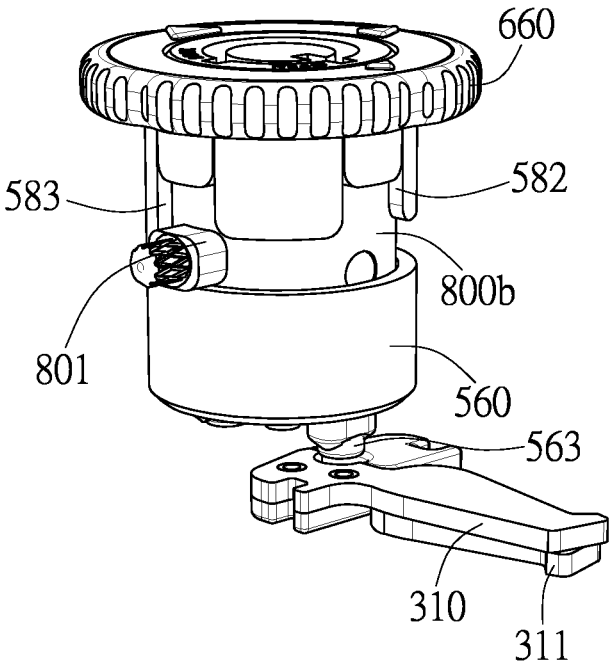
Figure 8D:
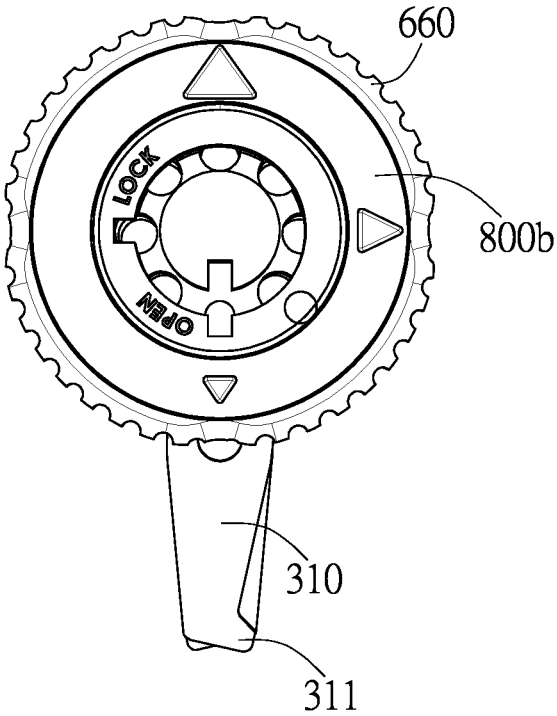
Figure 9A:
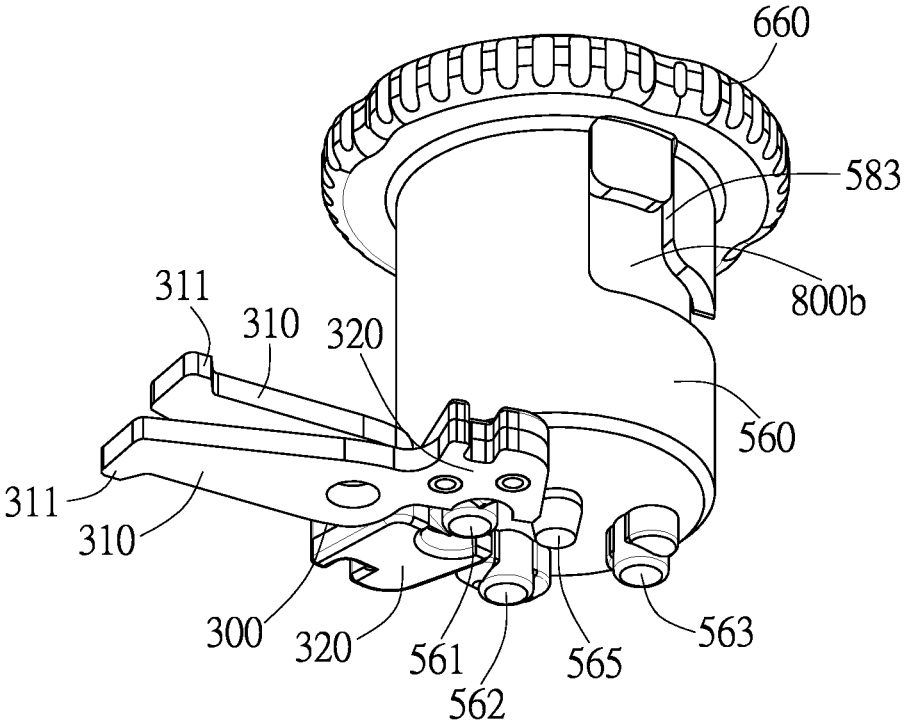
FIGS. 9A to 11D are perspective views showing the driving member moving along the Z-axis direction to cause one of the first driving portion, the second driving portion, and the third driving portion to extend by a specific depth to be between the rear-end portions.
Figure 9B:
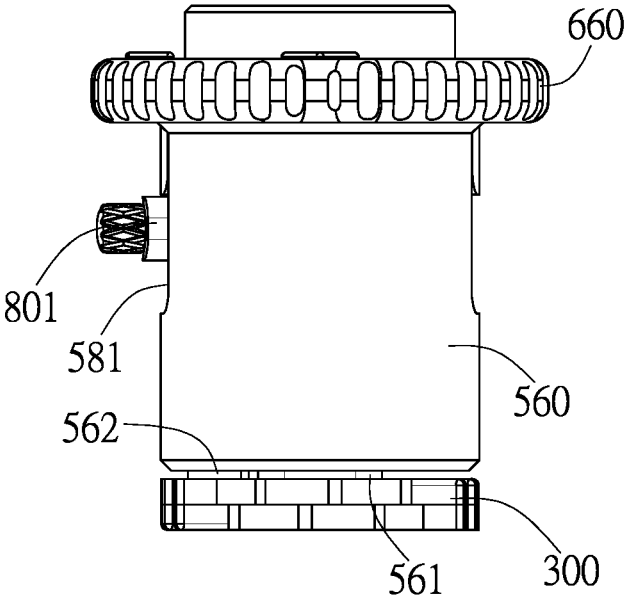
Figure 9C:
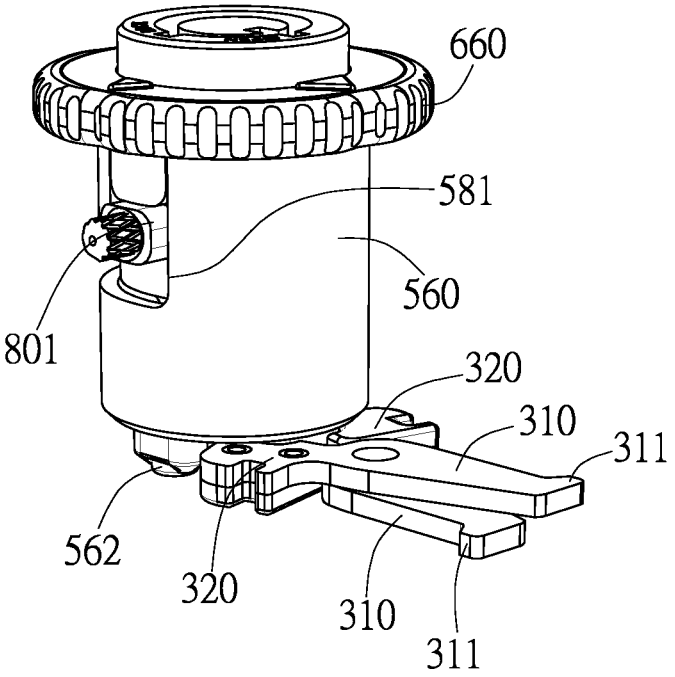
Figure 9D:
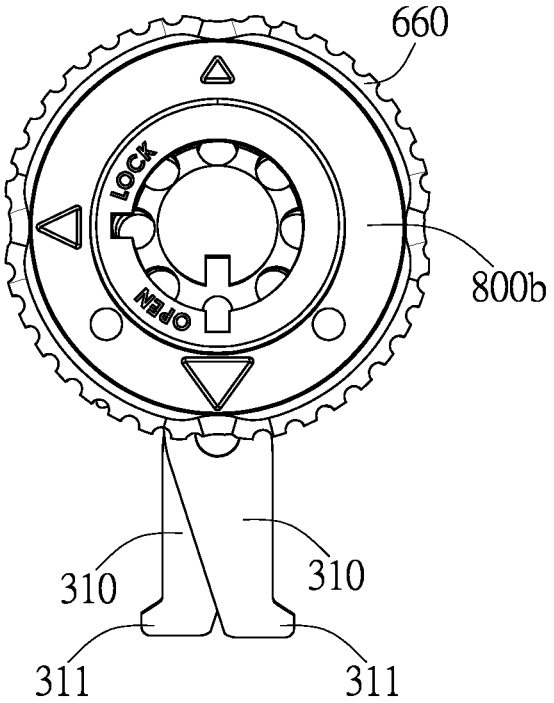
Figure 10A:
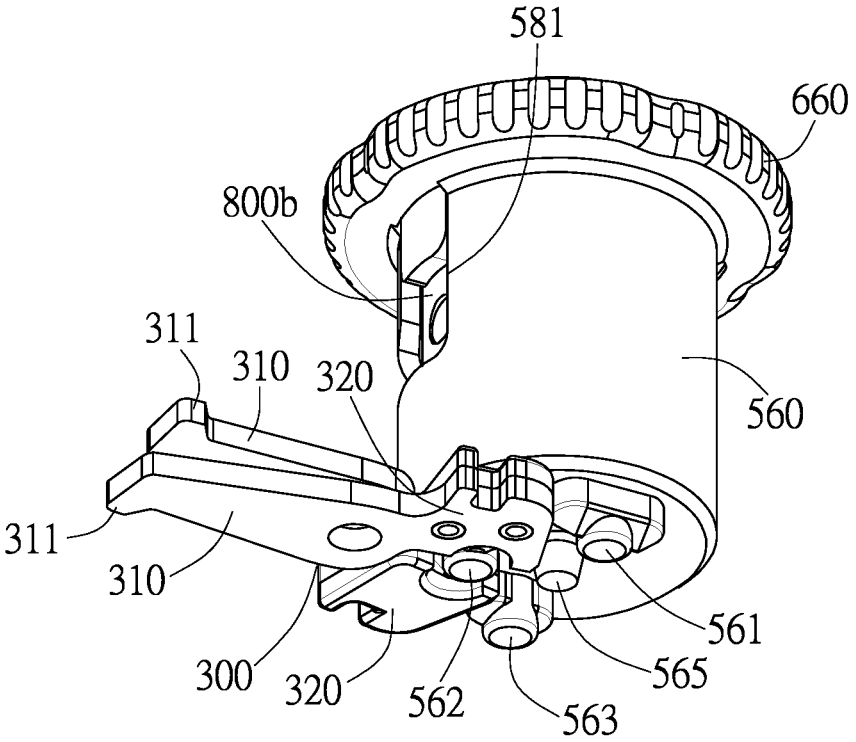
Figure 10B:
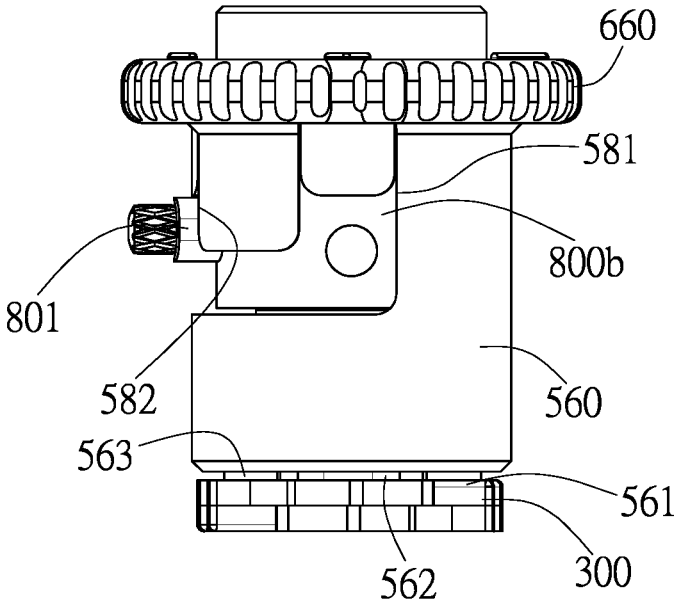
Figure 10C:
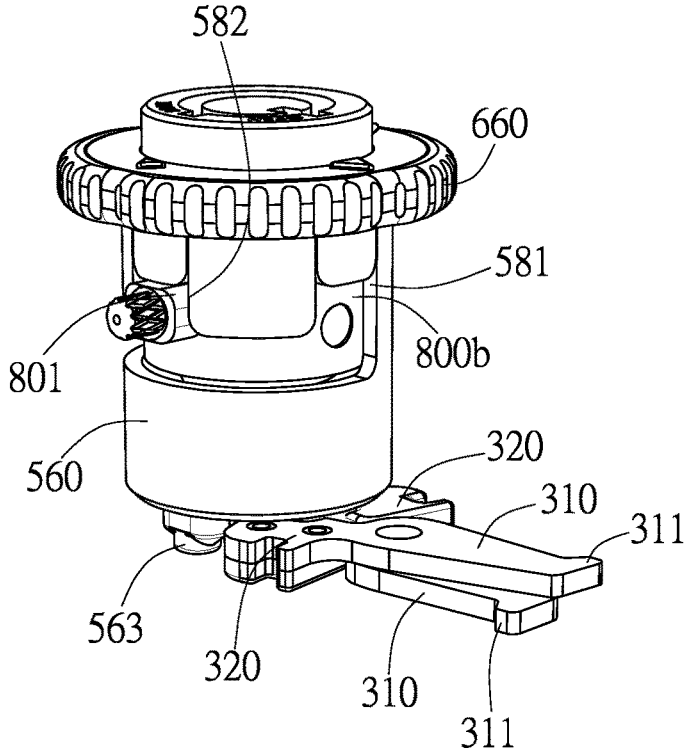
Figure 10D:
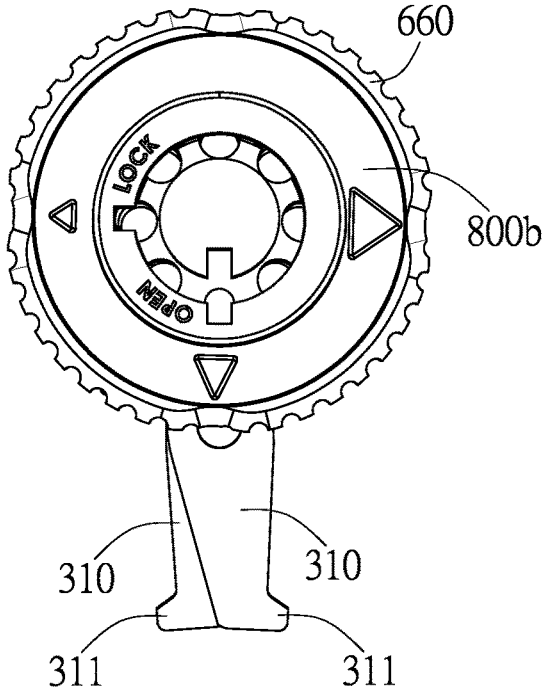
Figure 11A:
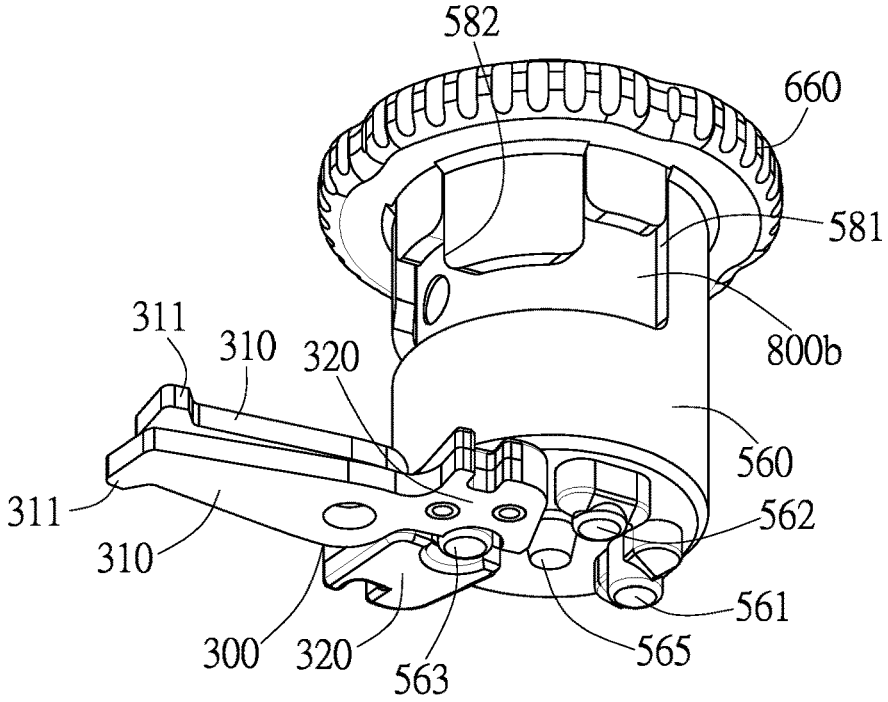
Figure 11B:
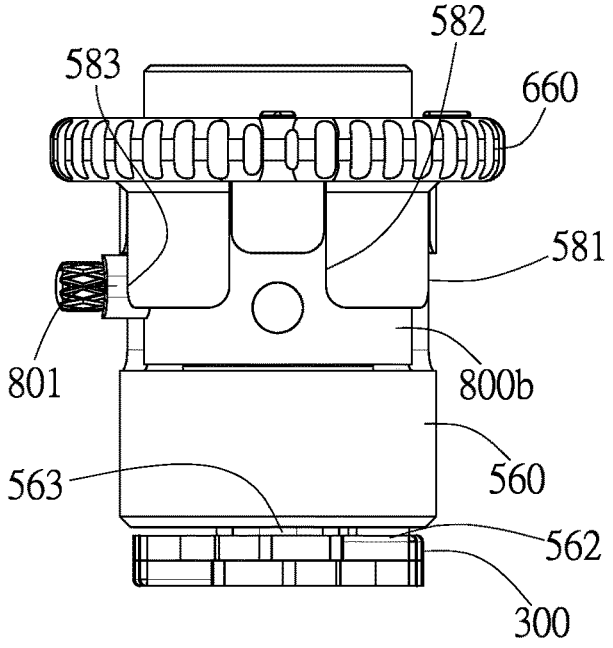
Figure 11C:
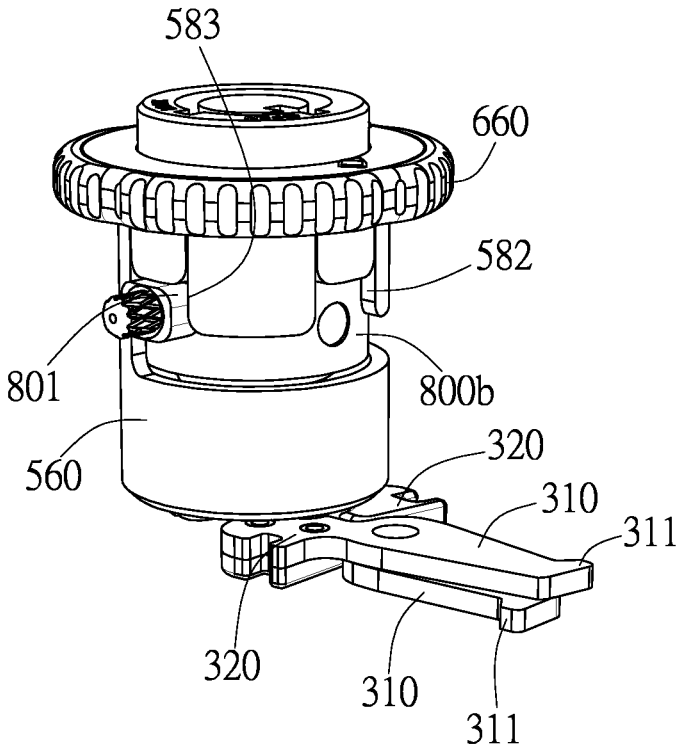
Figure 11D:
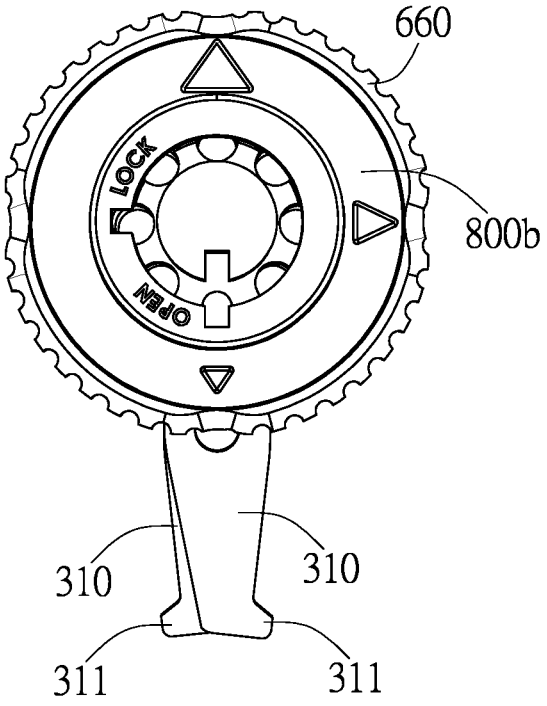

In an embodiment shown in FIG. 7, a lock device 920 of the present invention includes a housing 100*b*, a rotating hook 300, a driving device 702, and a lock body 800*b*. An end of the housing 100*b* has a front opening 110*b*. The rotating hook 300 is disposed in the housing 100*b*, and may rotate relative to the housing 100*b* along a plane parallel to an X-Y plane, and be scissor-shaped. The rotating hook 300 includes a front-end portion 310 and a rear-end portion 320. The front-end portion 310 at least partially protrudes from the front opening 110, and an end of the front-end portion 310 has a hook portion 311 extending laterally. The rear-end portion 320 extends toward a direction opposite to the front-end portion 310. The driving device 702 is disposed in the housing 100*b* and may be selectively moved to a first position and a second position, so as to extend along a Z-axis direction by a first depth and a second depth to be between the rear ends 320, respectively, so that the front-end portion 310 is opened by a first width and a second width, respectively. The lock body 800*b* is disposed in the driving device 702. More particular, the driving device 702 is cylindrical, and the lock body 800*b* is sleeved in the driving device 702. When the lock body 800*b* is locked, the lock body 800*b* restricts movement of the driving device 702 along the Z-axis direction. An X axis, the Y axis, and a Z axis are orthogonal.

The driving device 702 includes a driving member 560 and a force applying member 660, and may further include an elastic device 720. The driving member 560 includes a driving member bottom surface 564. The driving member bottom surface 564 orients toward the rotating hook 300 and has a first driving portion 561, a second driving portion 562, and a third driving portion 563. The driving member 560 may rotate along the plane parallel to the X-Y plane, so that the first driving portion 561, the second driving portion 562, and the third driving portion 563 correspond to the gap between the rear-end portions 320. In other words, through a rotation of the driving member 560, projections of the first driving portion 561, the second driving portion 562, and the third driving portion 563 on the X-Y plane overlap with a projection of the gap between the rear-end portions 320 on the X-Y plane. Therefore, when the driving member 560 is moved toward the rotating hook 300 along the Z-axis direction, one of the first driving portion 561, the second driving portion 562, and the third driving portion 563 may extend into the gap between the rear-end portions 320 to abut against the two rear-end portions 320 so as to cause the rear-end portions to be away from each other, thereby causing the hook portions 311 to be away from each other. In a preferred embodiment, sizes of the first driving portion 561, the second driving portion 562, and the third driving portion 563 are different, and are elements with a sharp cone respectively to apply a force to the rear-end portion 320. For example, a shaft hole is further disposed in the housing 100*b* for a driving member shaft 565 of the driving member 560 to be inserted.

In the embodiment shown in FIG. 7, the force applying member 660 is disposed on a top of the driving member 560. The elastic device 720 is disposed between the driving member 560 and an inner wall of the housing 100*b*, and is configured to apply an elastic force to cause the driving member 560 to move upward along the Z-axis direction. When the force applying member 660 receives an external force and moves downward along the Z axis, the driving member 500 moves along the Z-axis direction, so that one of the first driving portion 561, the second driving portion 562, and the third driving portion 563 extends by a specific depth to be between the rear-end portions 320, thereby causing the front-end portion 310 to be opened by a specific width. When the force applying member 660 receives an external force and rotates along the plane parallel to the X-Y plane, the driving member 500 may be driven to rotate along the plane parallel to the X-Y plane, thereby changing the positions of the first driving portion 561, the second driving portion 562, and the third driving portion 563.

Actuation of the lock device 920 is further illustrated below.

In an embodiment shown from FIG. 8A to FIG. 8D, when a force applying member 660 does not receive an enough external force to move downward along a Z axis, a driving member 500 does not move downward along the Z axis direction based on an elastic force provided by an elastic device 720 to cause the first driving portion 561, the second driving portion 562, and the third driving portion 563 to extend by a specific depth to be between the rear-end portions 320, thereby causing the front-end portion 310 to open by a specific width. In this case, because the hook portions 311 do not interfere with a side wall of a lock hole, a rotating hook 300 of a lock device 920 may enter the lock hole.

In addition, a displacement limiting member 801 is disposed on a side wall of the lock body 800*b*, and a first guide groove 581, a second guide groove 582, and a third guide groove 583 are disposed on a side wall of the driving member 560. When the driving member 560 is rotated to the displacement limiting member 801 respectively to correspond to one of the first guide groove 581, the second guide groove 582, and the third guide groove 583, the force applying member 660 may be moved downward along the Z axis to cause the displacement limiting member 801 to enter one of the first guide groove 581, the second guide groove 582, and the third guide groove 583, thereby causing one of the first driving portion 561, the second driving portion 562, and the third driving portion 563 to extend to be between the end portions 320.

Afterwards, in an embodiment shown from FIG. 9A to FIG. 11D, when the force applying member 660 receives an enough external force and moves downward along the Z axis, the driving member 560 moves along the Z-axis direction to cause one of the first driving portion 561, the second driving portion 562, and the third driving portion 563 to extend by a specific depth to be between the rear-end portions 320, thereby causing the front-end portion 310 to be opened by a specific width. In this case, the hook portions 311 interfere with a side wall of a lock hole 401 to cause a movement of the rotating hook 300 of the lock device 920 to be prevented from leaving the lock hole, and the lock device 920 is locked in the lock hole. More particular, positions of the first driving portion 561, the second driving portion 562, and the third driving portion 563 may be changed through rotating the force applying member 660, and then pressing-down is performed to cause one of first driving portion, the second driving portion, and the third driving portion to extend between the rear ends 320. Due to different sizes of the three driving portions, the front-end portion 310 is opened by different widths.

Figure 12A:
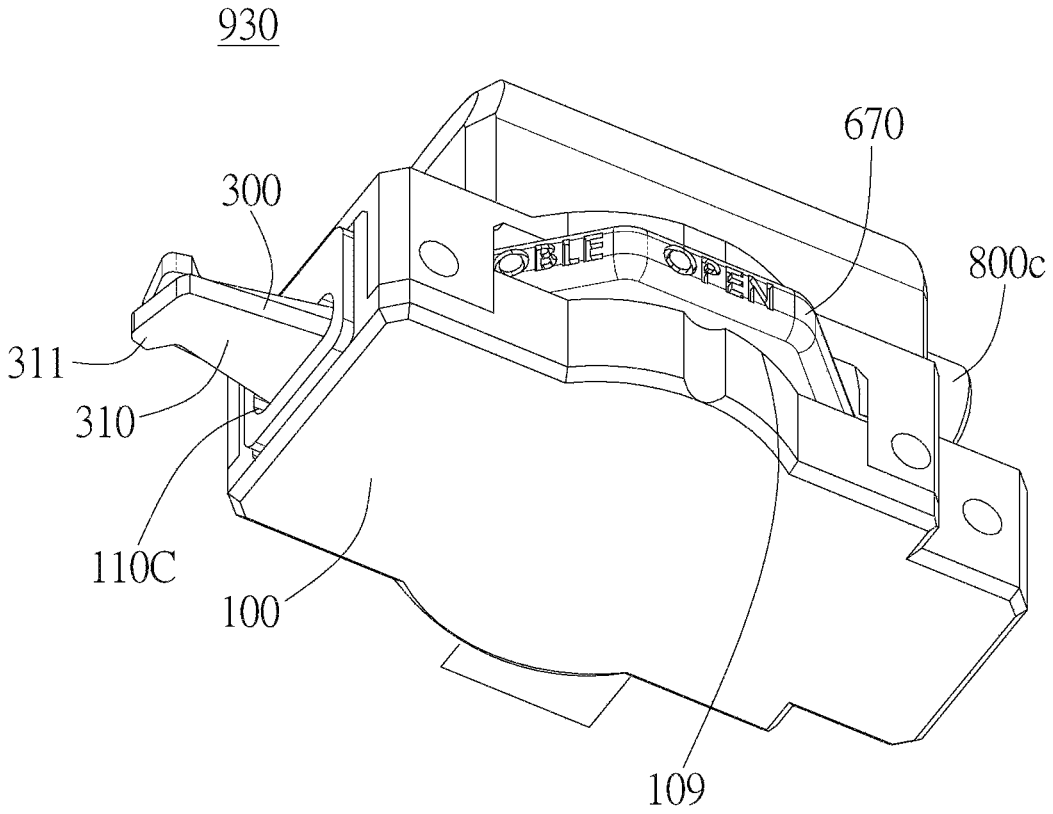
FIG. 12A is a perspective view of different embodiment of the lock device of the present invention.
Figure 12B:
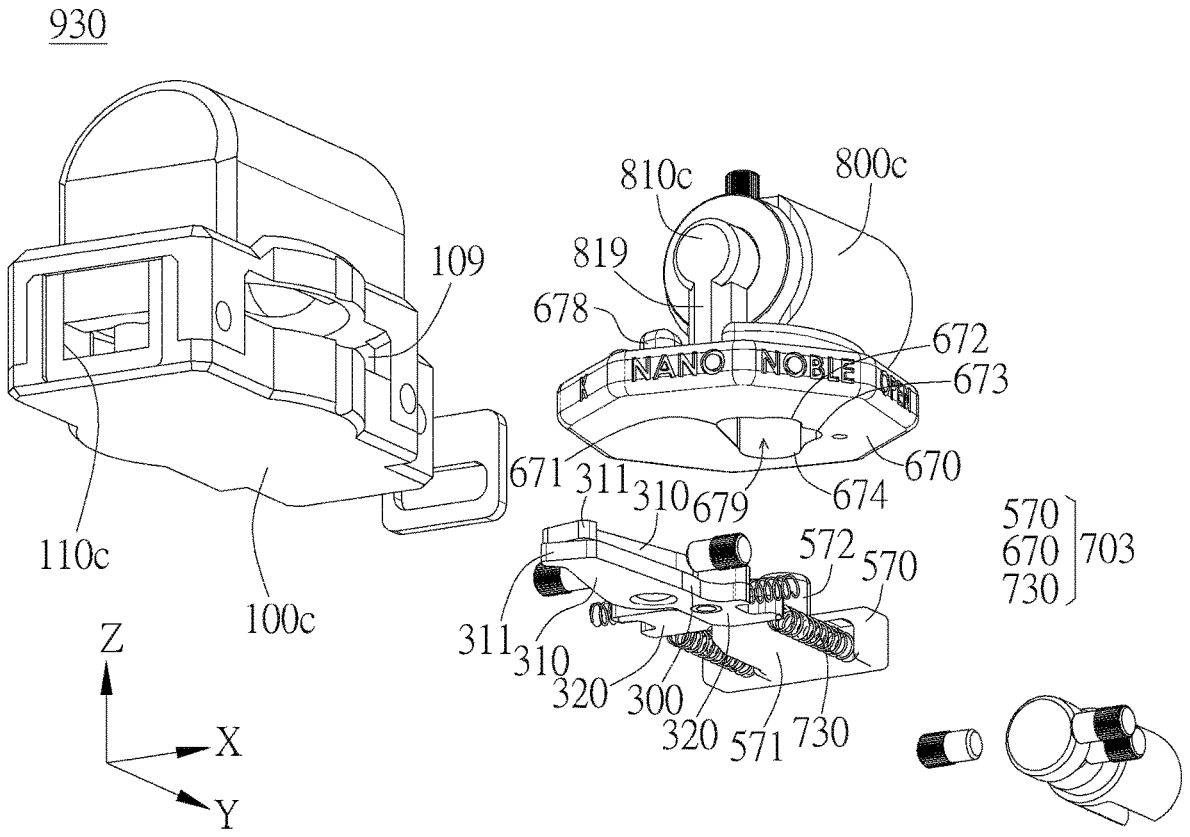
FIG. 12B is exploded view of different embodiment of the lock device of the present invention.
Figure 13A:
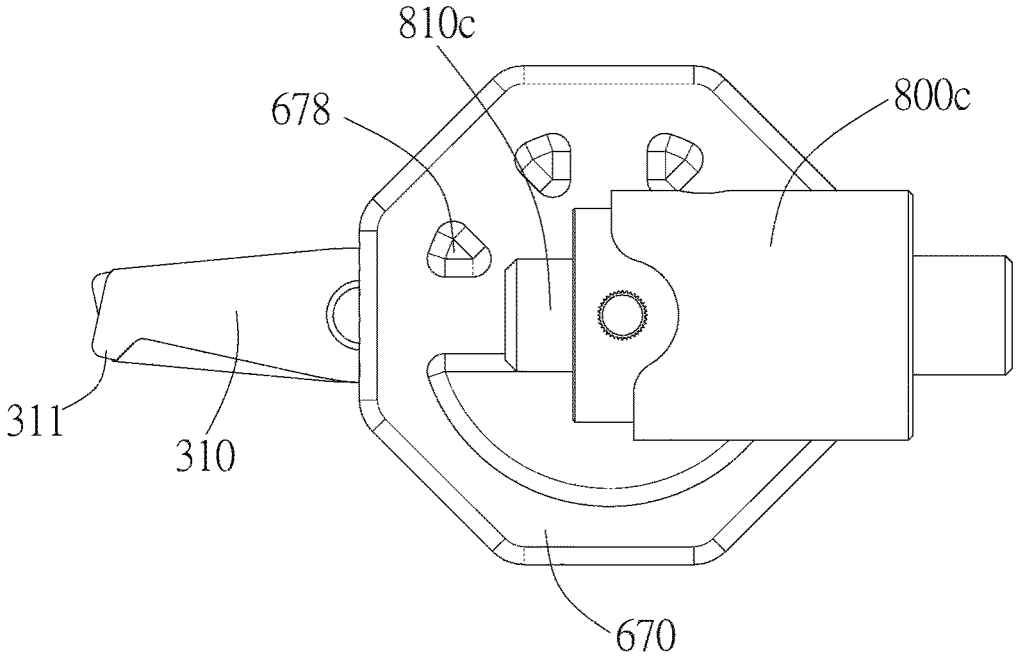
FIGS. 13A to 13E are perspective views showing the driving member not moving along the Y axis to be between the rear-end portions.
Figure 13B:
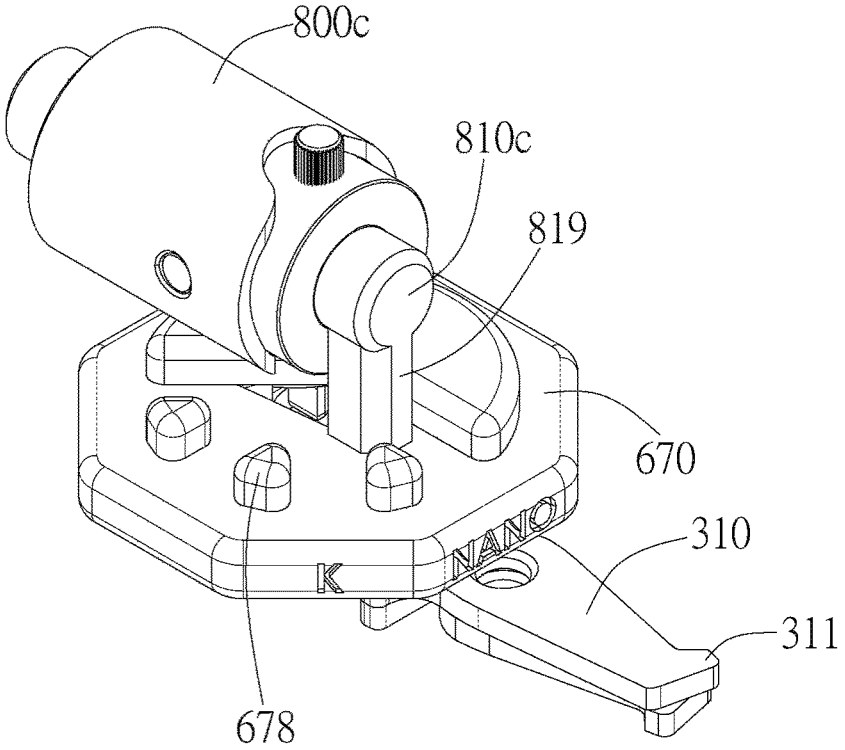
Figure 13C:
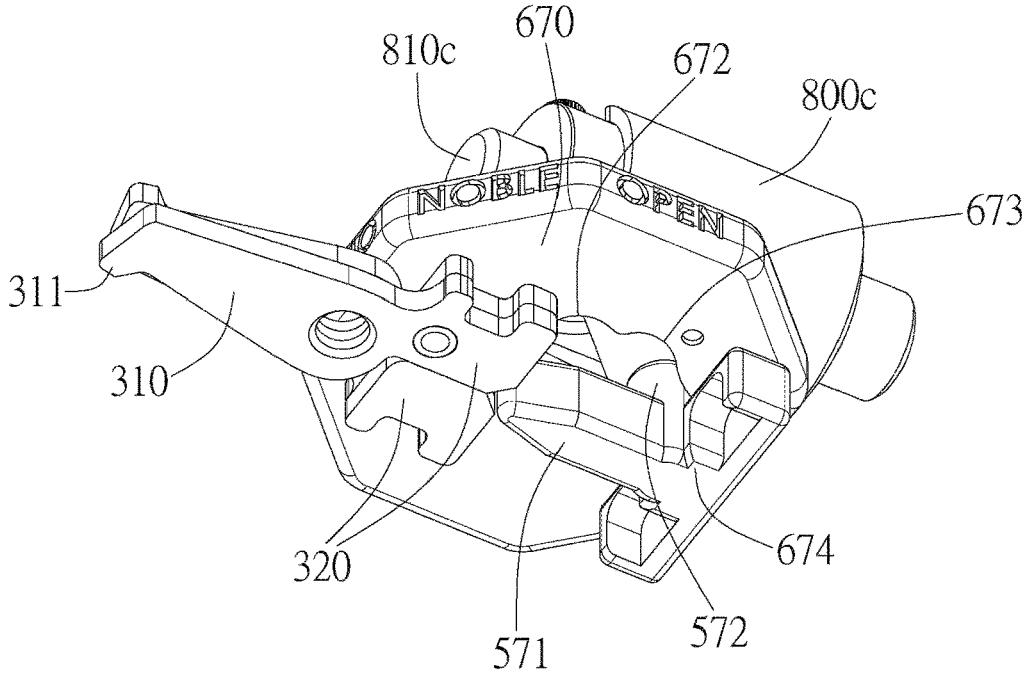
Figure 13D:
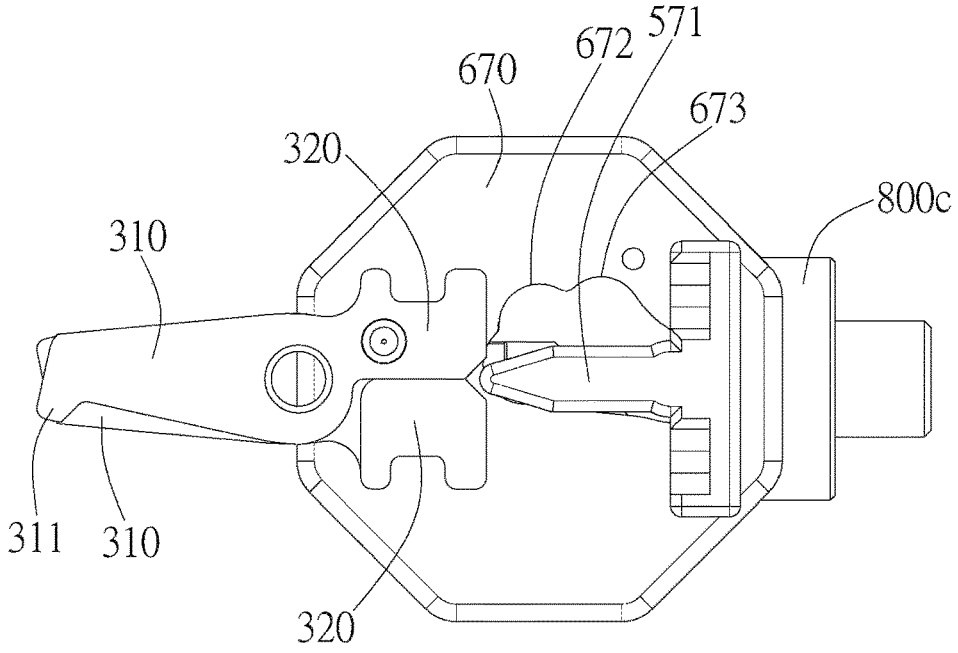
Figure 13E:
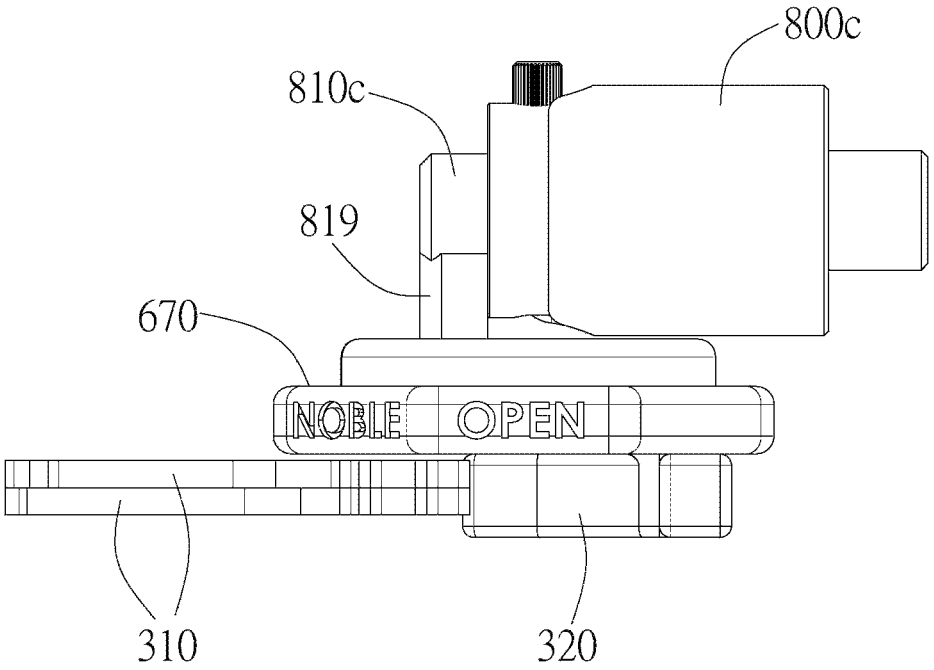
Figure 14A:
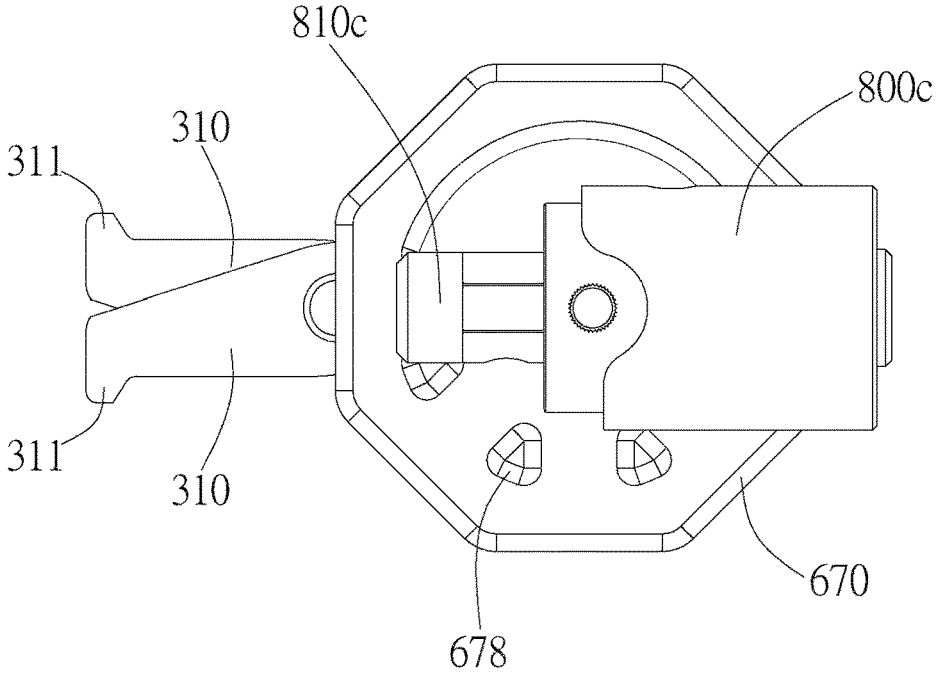
FIGS. 14A to 16E are perspective views showing the driving member moving along the Y axis to be between the rear-end portions.
Figure 14B:
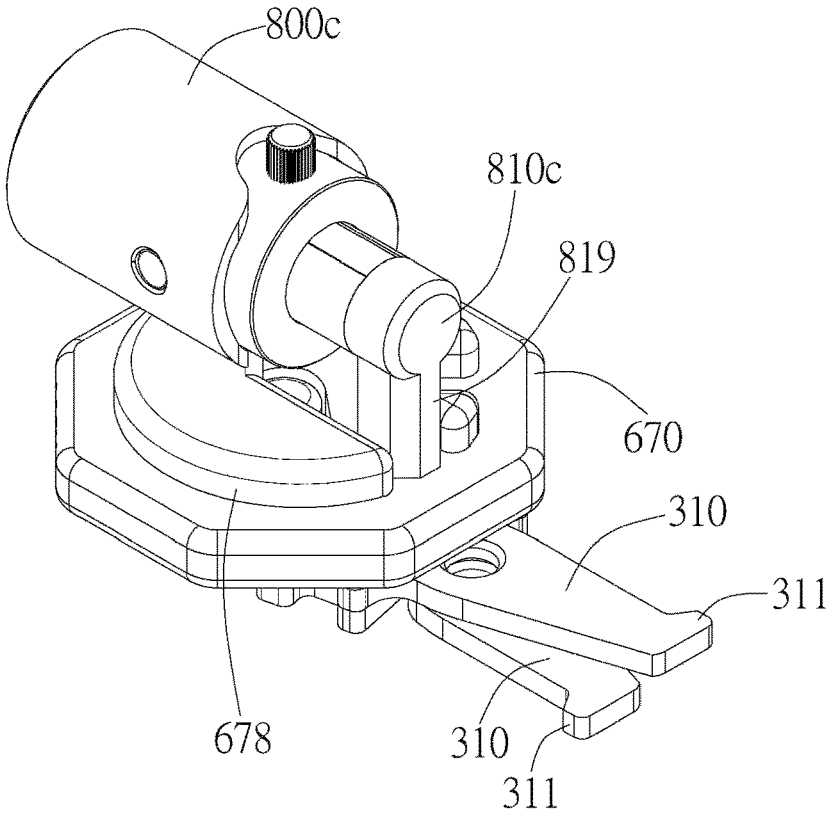
Figure 14C:
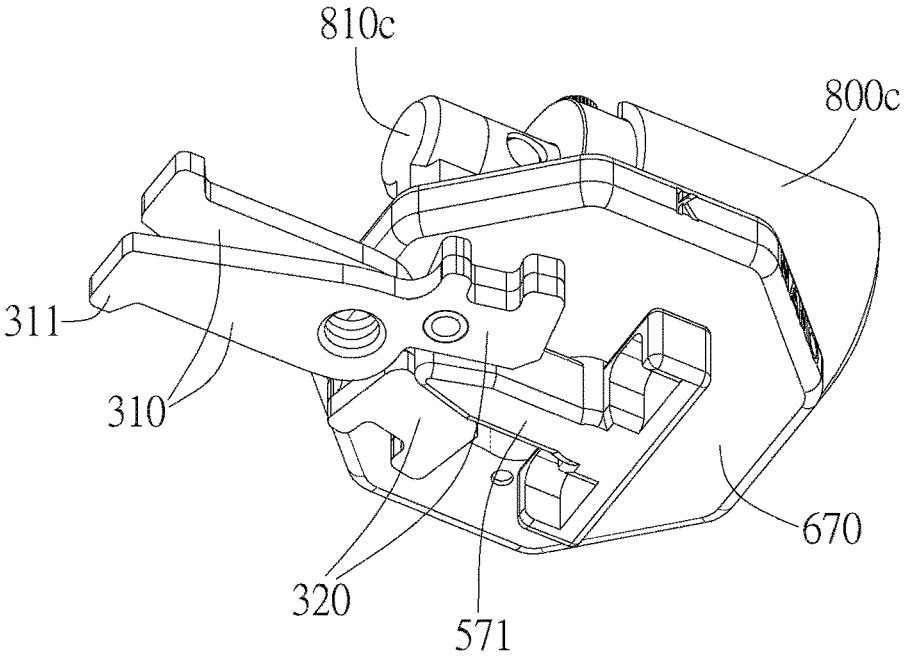
Figure 14D:
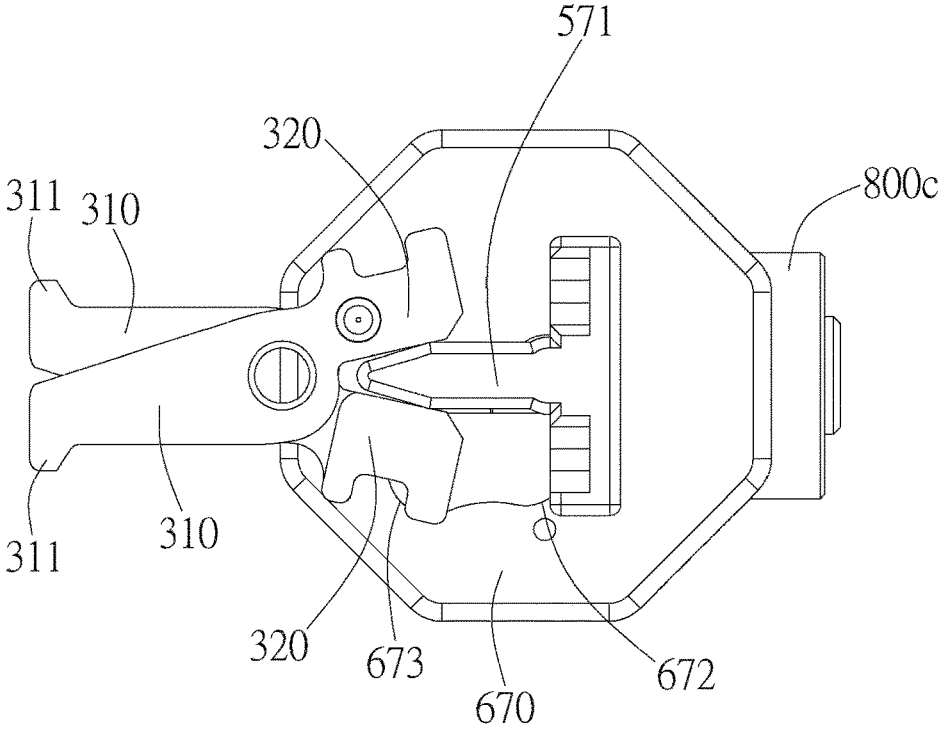
Figure 14E:
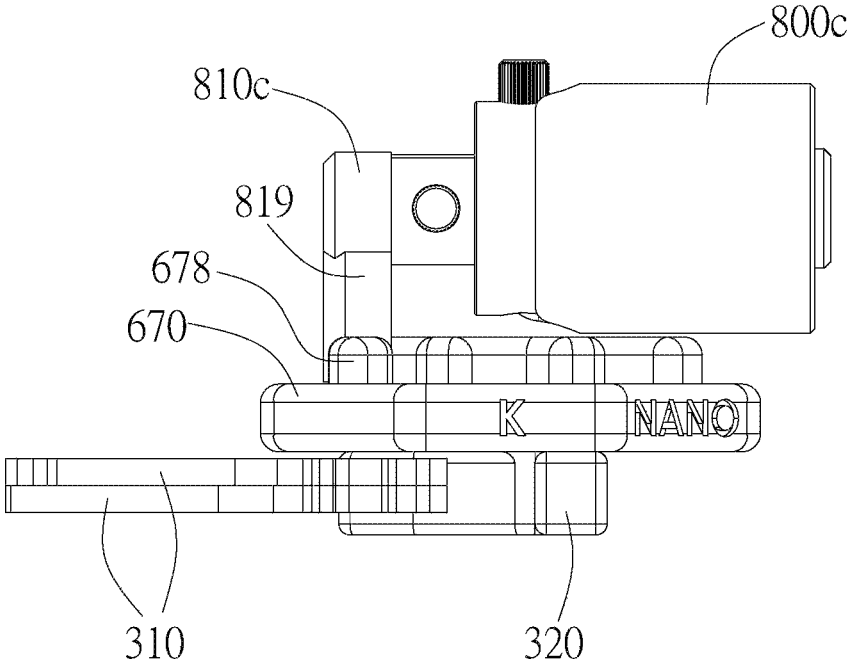
Figure 15A:
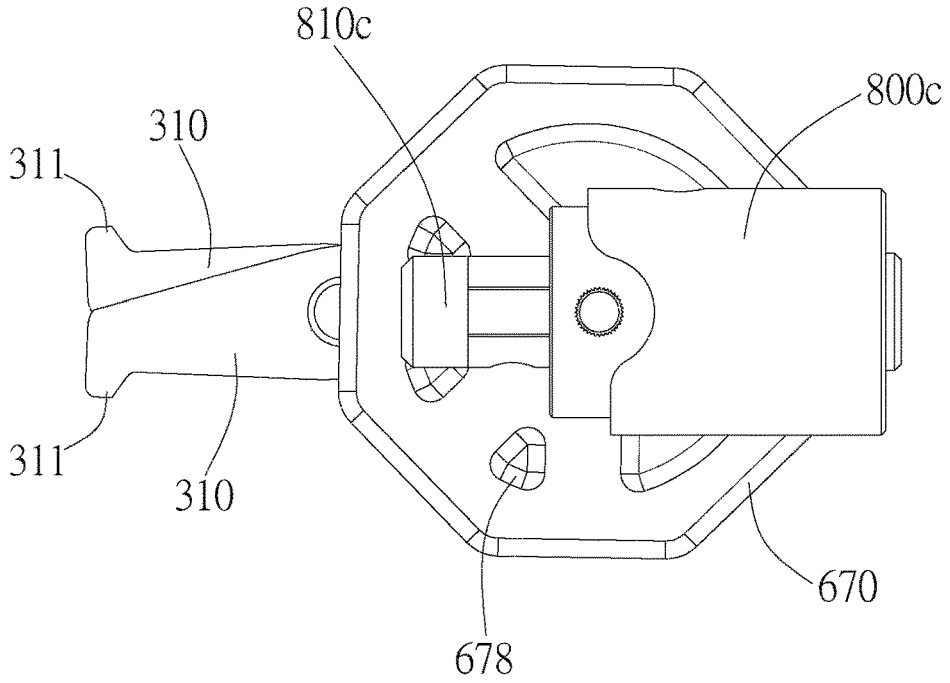
Figure 15B:
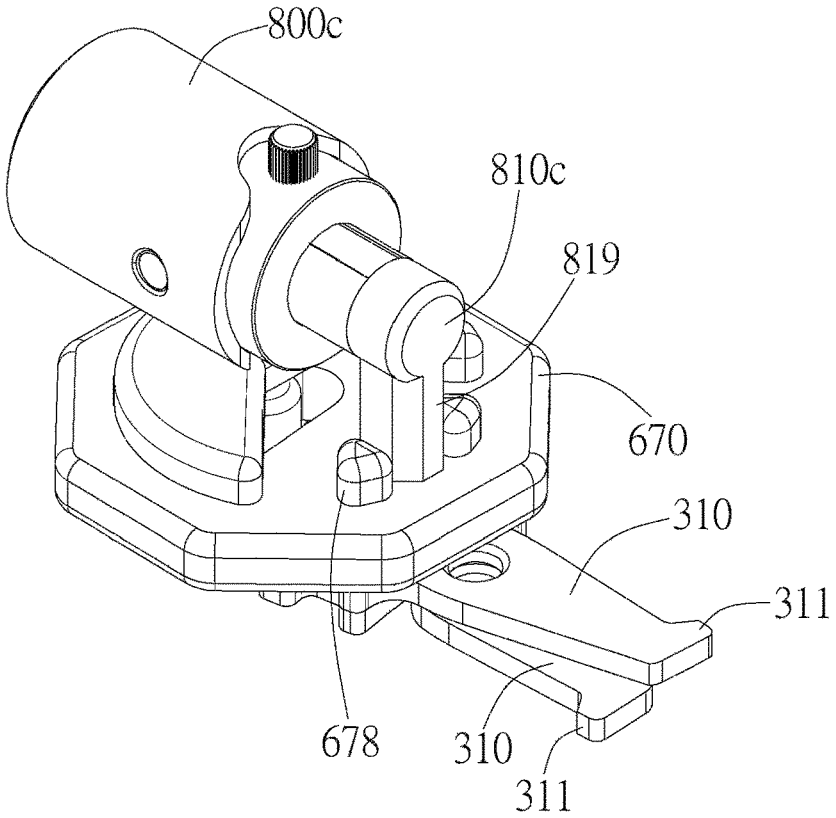
Figure 15C:
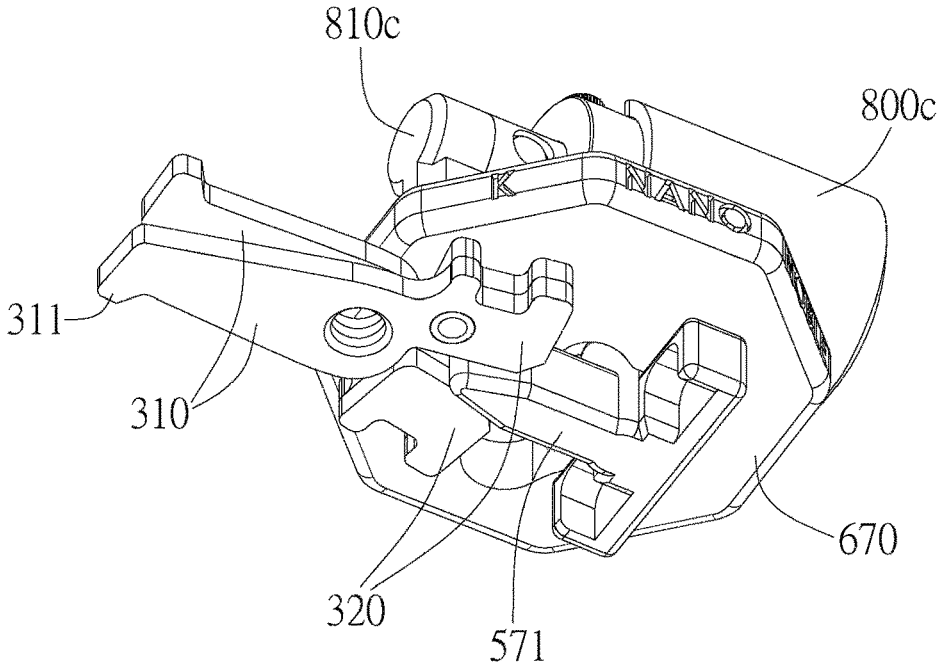
Figure 15D:
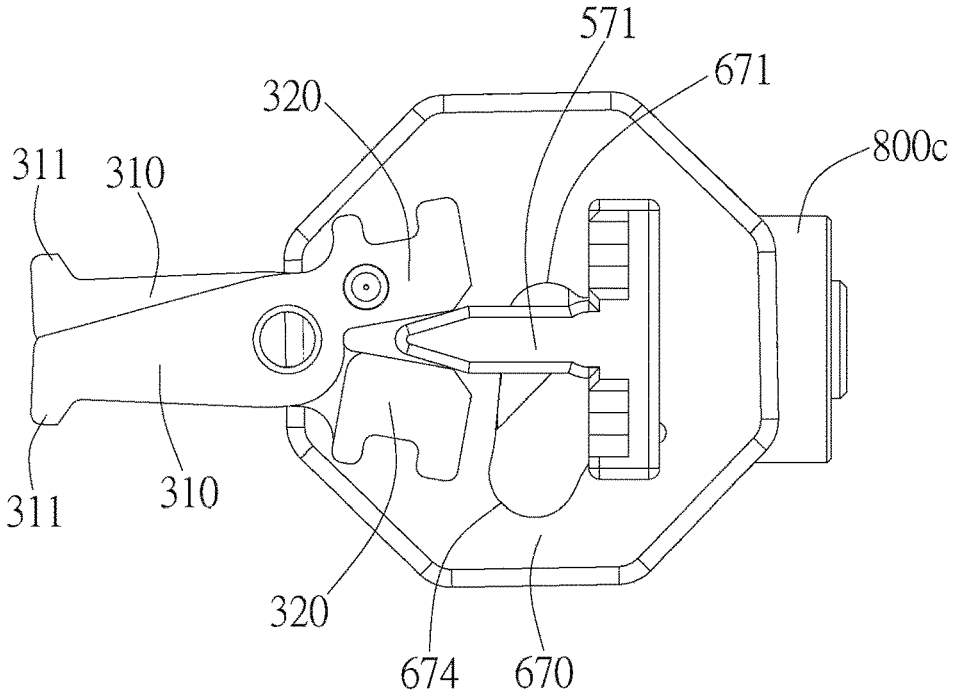
Figure 15E:
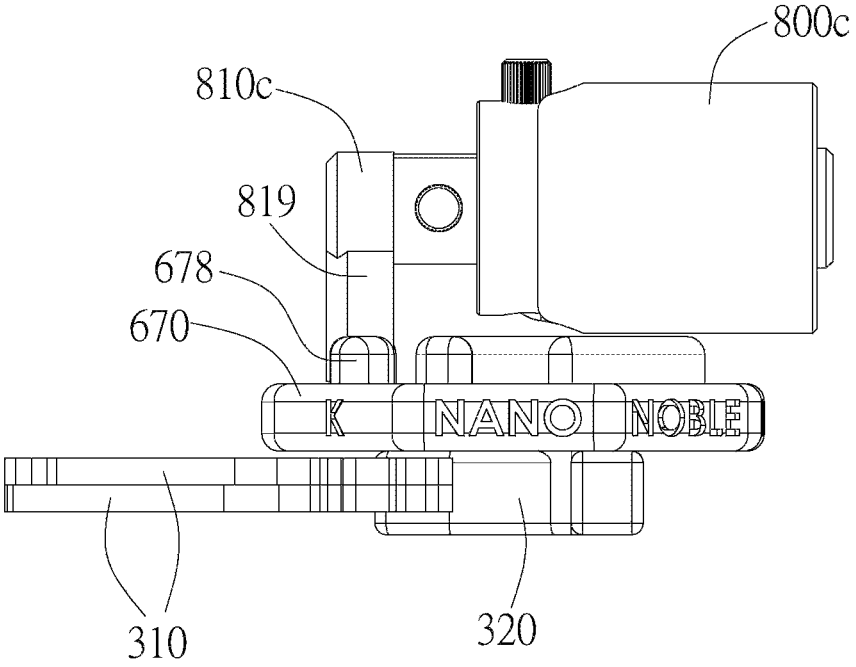
Figure 16A:
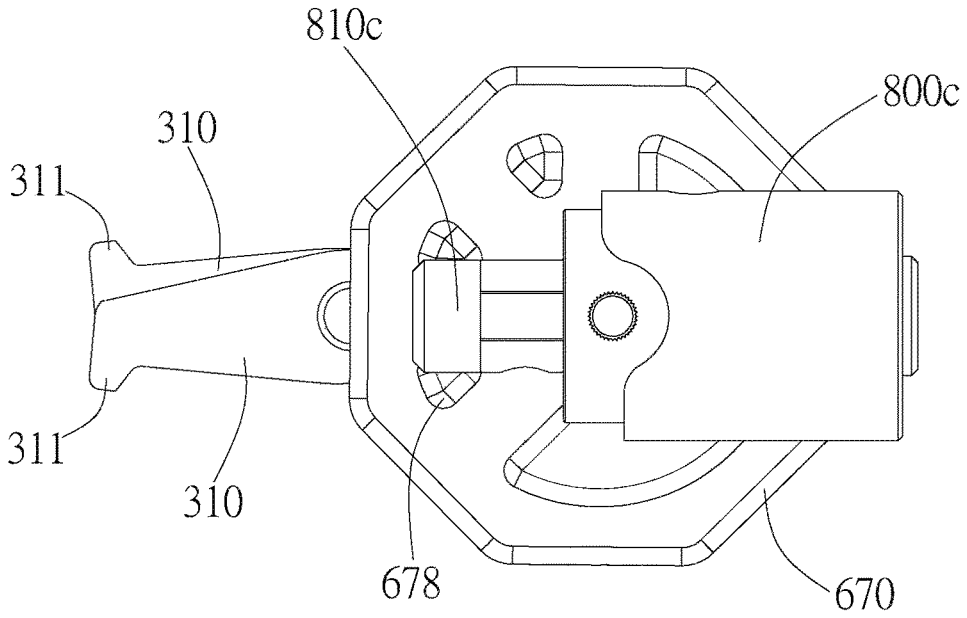
Figure 16B:
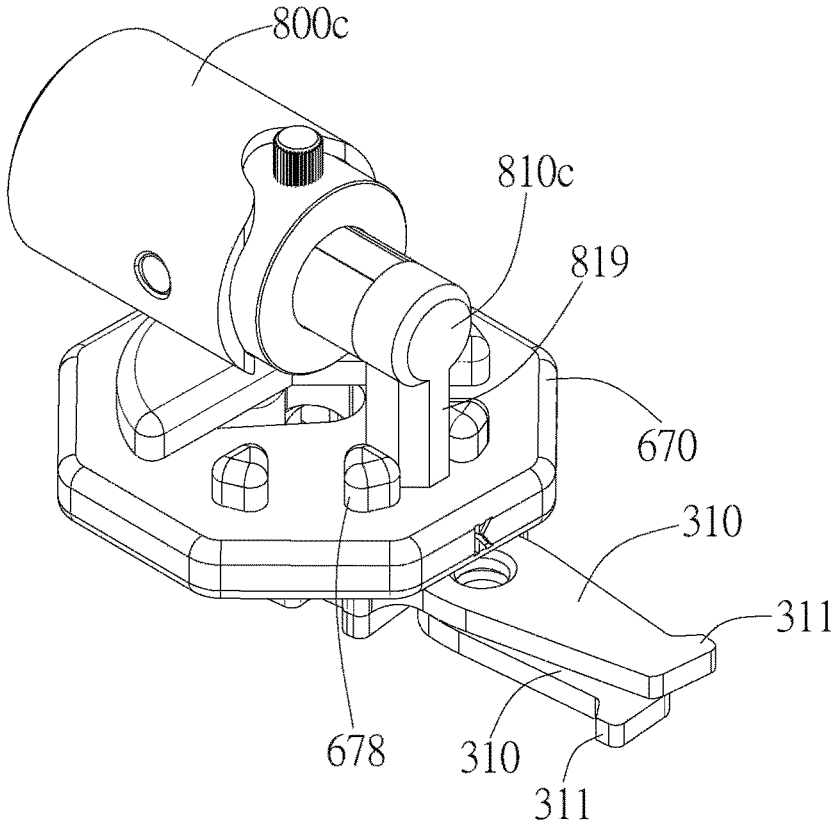
Figure 16C:
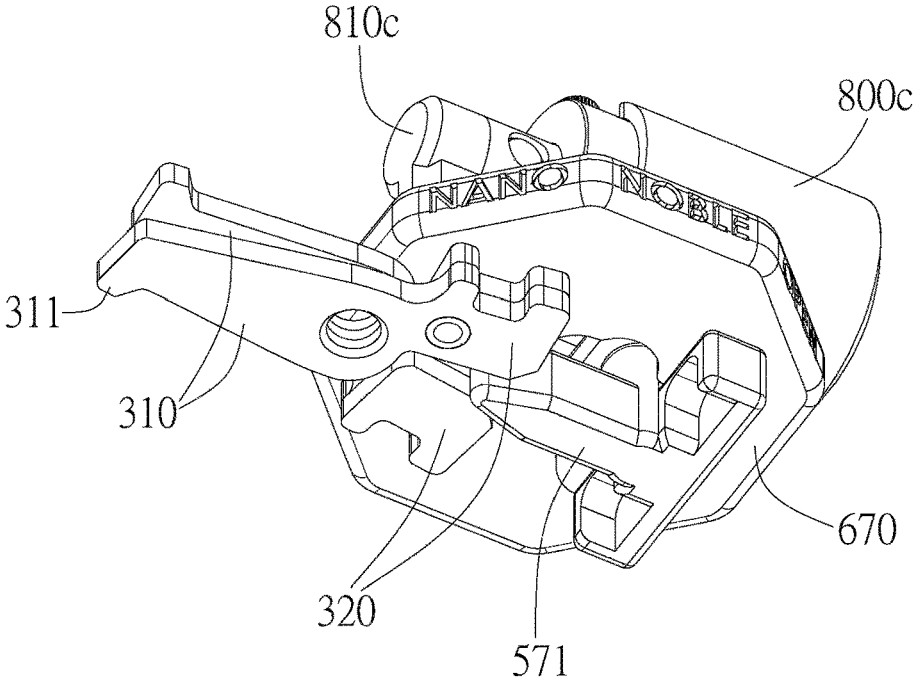
Figure 16D:
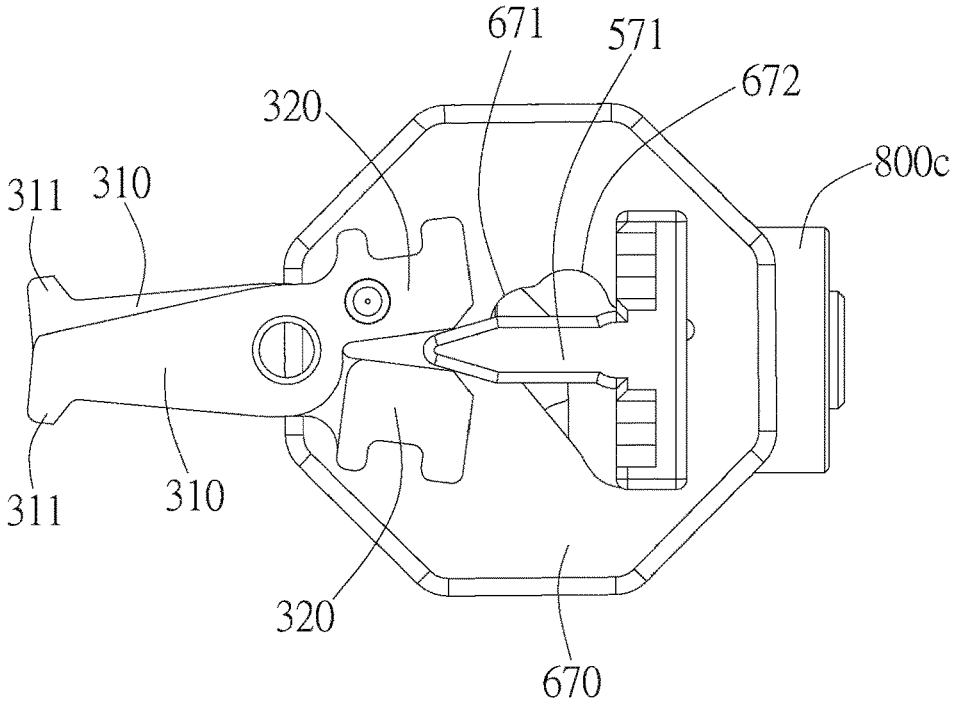
Figure 16E:
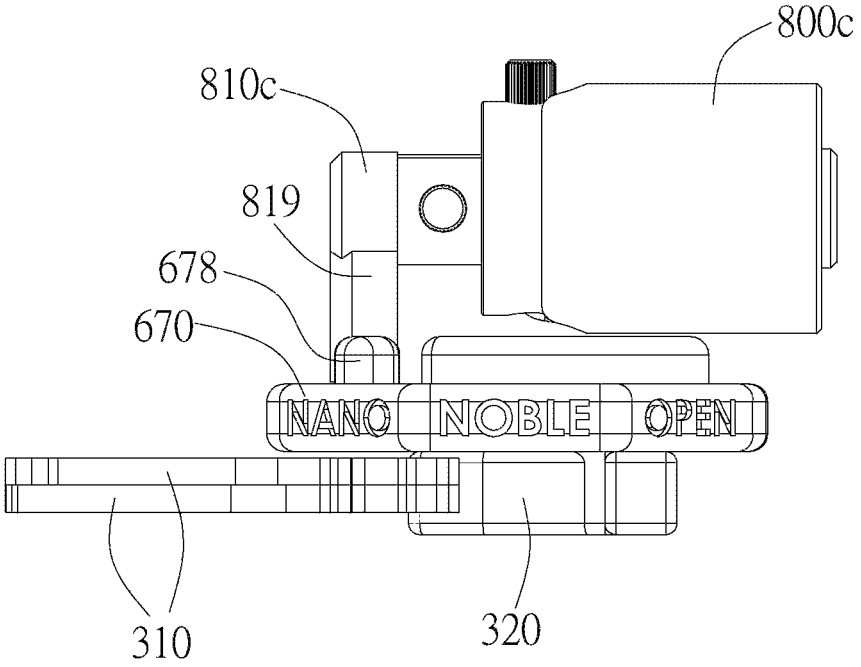

In an embodiment shown from FIG. 12A and FIG. 12B, a lock device 930 of the present invention includes a housing 100*c*, a rotating hook 300, a driving device 703, and a lock body 800*c*. An end of the housing 100*c* has a front opening 110*c*. The rotating hook 300 is disposed in the housing 100*c* substantially extends along a Y axis, and may rotate relative to the housing 100*c* along a plane parallel to an X-Y plane, and be scissor-shaped. The rotating hook 300 includes a front-end portion 310 and a rear-end portion 320. The front-end portion 310 at least partially protrudes from the front opening 110*c*, and an end of the front-end portion 310 has a hook portion 311 extending laterally. The rear-end portion 320 extends toward a direction opposite to the front-end portion 310. The driving device 703 is disposed in the housing 100*c* and may be selectively moved to a first position and a second position along a Y-axis direction, so as to extend by a first length and a second length to be between the rear ends 320, respectively, so that the front-end portion 310 is opened by a first width and a second width, respectively. The lock body 800*c* is disposed in the housing 100*c*. When the lock body 800*c* is locked, the lock body 800*c* restricts movement of the driving device 703 along the Y-axis direction. An X axis, the Y axis, and a Z axis are orthogonal.

In the embodiment shown in FIG. 12B, the driving device 703 is disposed in the housing 100*c* and includes a driving member 570 and a force applying member 670, and may further include an elastic device 730. The driving member 570 includes a driving portion 571 extending along the Y-axis direction and a driving member shaft 572 extending along the Z axis. The driving member 570 may be moved along the Y-axis direction to cause the driving portion 571 to be inserted into a gap between the rear-end portions 320 to abut against the rear-end portions 320 to cause the rear-end portions to be away from each other, so that the hook portions 311 are away from each other.

In the embodiment shown in FIG. 12B, the force applying member 670 is disposed in the housing 100*c* and is located on a side of the driving member 570. The force applying member 670 has a force applying hole 679 for the driving member shaft 572 to be inserted. The force applying member 600 may rotate relative to the housing 100 along the plane parallel to the X-Y plane. More particular, a hollow groove 109 is provided on a side of the housing 100*c*, and the force applying member 670 is preferably disc-shaped. A periphery of the force applying member 670 may at least partially extend out of the hollow groove 109 for receiving an external force to rotate the force applying member 670.

In the embodiment shown in FIG. 12B, the elastic device 730 is disposed between the driving portion 571 and the rear-end portion 320, and is configured to apply an elastic force to cause the driving portion 571 to be away from the rear-end portion 320. Because a driving member shaft 572 is inserted into a force applying hole 679, when the force applying member 670 is rotated relative to the housing 100*c* along the plane parallel to the X-Y plane to cause the driving member shaft 572 to abut against an inner edge of the force applying hole 679, a position of the driving member shaft 572 along the Y-axis direction is changed, and therefore the driving portion 571 is moved along the Y-axis direction. Therefore, by rotating the force applying member 670, the driving member 570 may be moved along the Y-axis direction. In other words, the force applying member 670 may be rotated to cause the driving member 570 to move to a specific position, so that the driving portion 571 extends by a specific depth to be between the rear-end portions 320, and the front-end portion 310 is opened by a specific width.

More particular, in the embodiment shown in FIG. 12B, an inner edge of the force applying hole 679 includes a first recess 671, a second recess 672, a third recess 673, and a fourth recess 674. When the force applying member 670 rotates relative to the housing 100 along the plane parallel to the X-Y plane, the driving member shaft 572 may abut against the inner edge of the force applying hole 679 and enter one of these recesses. Because these recesses have different distances from a rotation center of the force applying member 670, when the driving member shaft 572 enters different recesses, positions thereof on the Y-axis direction are also different. Accordingly, a depth at which the driving portion 571 extends between the rear-end portions 320 may be controlled, so that the front-end portion 310 is opened by a specific width.

In an embodiment shown in FIG. 12B, the lock body 800*c* is disposed in the housing 100*c*. More particular, a braking element 810*c* is disposed at an end of the lock body 800*c*. However, in different embodiments, the lock body 800*c* may be a combination lock or other lock bodies.

In an embodiment shown in FIG. 12B, when the lock body 800*c* is locked, the braking element 810*c* extends out of the lock body 800*c* and is engaged with the force applying member 670 to restrict the rotation of the force applying member 670, thereby restricting the movement of the driving member 570 along the Y-axis direction, and further restricting rotation of the rotating hook 300. More particular, the braking element 810*c* includes a positioning portion 819. A plurality of bumps 678 are disposed on a top surface of the force applying member 670. When the braking element 810*c* extends out of the lock body 800*c*, the positioning portion 819 may enter a gap between two of the bumps 678 to restrict the rotation of the force applying member 670. When the lock body 800*c* is unlocked, the braking element 810*c* is not engaged with the force applying member 670, and does not restrict the rotation of the force applying member 670.

The driving member 570 may move along the Y-axis direction, and the rotating hook 300 may rotate.

Actuation of the lock device 930 is further illustrated below.

In an embodiment shown from FIG. 13A to FIG. 13E, when the force applying member 670 is rotated to cause the driving member shaft 572 to enter the fourth recess 674, the driving portion 571 does not extend for a depth to be between the rear end 320, and the front end 310 is not opened by a specific width. In this case, because the hook portions 311 do not interfere with a side wall of the lock hole, the rotating hook 300 of the lock device 930 may enter the lock hole.

Afterwards, in an embodiment shown from FIG. 14A to FIG. 16E, a force applying member 670 receives an external force to be rotated, and a driving member shaft 572 enters one of a first recess 671, a second recess 672, and a third recess 673, so that the driving portion 571 extends by a specific depth to be between the rear portions 320, thereby causing the front end 310 is opened by a specific width. In this case, if a lock body 800*c* is locked, a braking element 810*c* extends out of a lock body 800*c*, and a positioning portion 819 enters a gap between two of the bumps 678 to restrict the rotation of the force applying member 670, and the hook portions 311 interfere with a side wall of the lock hole, so that a movement of the rotating hook 300 of the lock device 930 is restricted and the rotating hook cannot leave the lock hole, and the lock device 930 is locked in the lock hole. More particular, a position of the driving member shaft 572 along the Y-axis direction may be changed through rotating the force applying member 670 to cause the front end 310 to be opened by different widths.

In different embodiment, the rotating hook could be disposed in single. For example, the lock device further includes an end engaging part extending outward from the front opening 110 and being adjacent to the rotating hook 300. The driving device includes a driving member and a restricting part. The driving member is able to push the rear-end portions along the Y-axis direction, thereby causing the front-end portion to be away from the end engaging part. i.e. changing widths by which the front-end portion is opened with respect to the end engaging part. The restricting part is disposed in the housing 100 for restricting the movement of the driving device along the X-axis direction.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A lock device, comprising:

a housing with a front opening at an end;

at least two rotating hooks disposed in the housing and being rotatable relative to the housing along a plane parallel to an X-Y plane having a X-axis and a Y-axis, each of the rotating hook comprising a front-end portion and a rear-end portion, the front-end portion at least partially protruding from the front opening, and the rear-end portion extending toward a direction opposite to the front-end portion;

a driving device disposed in the housing and selectively moveable to change widths by which the front-end portions are opened respectively; and a lock body disposed in the housing, when the lock body is locked, the lock body restricting a movement of the driving device, wherein the driving device includes a driving portion being capable of moving along a Z-axis direction by different depths to be between the rear-end portions, respectively, wherein the width at the front-end portions of the rotating hooks is configured to change an amount which corresponds to the depth at which the driving portion is moved along the Z-axis direction, wherein, when the lock body is locked, the lock body is configured to restrict the movement of the driving portion along the Z-axis direction, the X axis, the Y axis, and the Z axis being orthogonal to each other.

2. The lock device according to claim 1, wherein the driving device comprises:

a driving member, comprising:

a driving member top surface located on one side of the driving member;

a driving member bottom surface located on one side of the driving member opposite to the driving member top surface, the driving member bottom surface orienting toward the rotating hooks and having the driving portion, wherein the driving portion corresponds to a gap between the rear-end portions, and when the driving member is moved toward the rotating hook along the Z-axis direction, the driving portion is capable of extending into the gap between the rear-end portions to abut against the rear-end portions to cause the rear-end portions to be away from each other, thereby causing the front-end portions to be away from each other; and a force applying member being rotatable relative to the housing along the plane parallel to the X-Y plane and comprising a force applying member top surface and a force applying member bottom surface located on opposite sides of the force applying member, the force applying member bottom surface orienting toward the driving member and having a force applying unit, wherein the force applying unit corresponds to the driving member top surface.

3. The lock device according to claim 2, wherein the driving device further comprises an elastic device disposed between the driving member and an inner wall of the housing and providing an elastic force applied between the driving member and an inner wall of the housing along the Z-axis direction.

4. The lock device according to claim 2, wherein the driving device member top surface comprises:

a guide ramp having a plurality of steps; and a stop disposed at a position adjacent to a bottom surface of the guide ramp, wherein the driving member top surface has a top surface position between the bottom surface of the guide ramp and the stop.

5. The lock device according to claim 2, wherein a braking element is disposed at an end of the lock body, when the lock body is locked, the braking element protruding toward the force applying member to be engaged with the force applying member to restrict a rotation of the force applying member, thereby restricting a movement of the driving device along the Z-axis direction.

6. The lock device according to claim 5, wherein the braking element has a fixing hole, and a periphery of the force applying member has a plurality of fixing portions, when the lock body is locked, the braking element protruding toward the force applying member, so that at least one of the fixing portions is inserted into the fixing hole.

7. The lock device according to claim 1, wherein the driving device comprises: a driving member comprising a driving member bottom surface orienting toward the rotating hooks and having a plurality of driving portions, wherein the driving member capable of being rotated to cause one of the driving portions to correspond to a gap between the rear-end portions, and when the driving member is moved toward the rotating hook along the Z-axis direction, the corresponding driving portion is capable of extending into the gap between the rear-end portions to abut against the rear-end portions to cause the rear-end portions to be away from each other, thereby causing the front-end portions to be away from each other.

8. The lock device according to claim 7, wherein a displacement limiting member protrudes from a side wall of the lock body, and a plurality of guide grooves are disposed on a side wall of the driving member, when the driving member is rotated to the displacement limiting member to correspond to one of the guide grooves, respectively, the force applying member moving downward from the Z axis to respectively cause the displacement limiting member to enter the corresponding guide groove, so that one of the driving portions extends between the rear-end portions.

9. The lock device according to claim 7, wherein the driving device further comprises an elastic device disposed between the driving member and an inner wall of the housing and providing an elastic force along the Z-axis direction.

* * * * *